US007206380B2

(12) United States Patent
Anno et al.

(10) Patent No.: US 7,206,380 B2
(45) Date of Patent: Apr. 17, 2007

(54) X-RAY APPARATUS

(75) Inventors: Hidero Anno, Otawara (JP); Koichi Kitade, Otawara (JP); Takayuki Kitami, Nasu-gun (JP); Hironori Nakamuta, Otawara (JP); Manabu Sato, Nasu-gun (JP)

(73) Assignees: Kabushiki Kaisha Toshiba, Tokyo (JP); Toshiba Electron Tubes & Devices, Co., Ltd., Tokyo (JP)

( * ) Notice: Subject to any disclaimer, the term of this patent is extended or adjusted under 35 U.S.C. 154(b) by 0 days.

(21) Appl. No.: 11/401,270

(22) Filed: Apr. 11, 2006

(65) Prior Publication Data

US 2006/0188068 A1 Aug. 24, 2006

Related U.S. Application Data

(63) Continuation of application No. PCT/JP2004/015387, filed on Oct. 18, 2004.

(30) Foreign Application Priority Data

Oct. 17, 2003 (JP) ..... 2003-358276

(51) Int. Cl.
*H01J 35/00* (2006.01)

(52) U.S. Cl. ..... 378/130; 378/141

(58) Field of Classification Search ..... 378/130, 378/141, 199, 200

See application file for complete search history.

(56) References Cited

U.S. PATENT DOCUMENTS 6,115,454 A * 9/2000 Andrews et al. ..... 378/140
6,519,317 B2 2/2003 Richardson et al. ..... 378/130
6,604,856 B2 * 8/2003 Baumgartner et al. ..... 378/200

FOREIGN PATENT DOCUMENTS

| | | |
|---|---|---|
| JP | 58-53456 U | 4/1983 |
| JP | 2001-502473 | 2/2001 |
| JP | 2001-164244 | 6/2001 |
| JP | 2002-150981 | 5/2002 |
| JP | 2002-216683 | 8/2002 |
| JP | 2003-197136 | 7/2003 |

OTHER PUBLICATIONS

International Search Report dated Aug. 11, 2005 for Appln. No. PCT/JP2004/015387 filed Oct. 18, 2004.

* cited by examiner

*Primary Examiner*—Edward J. Glick
*Assistant Examiner*—Jurie Yun
(74) *Attorney, Agent, or Firm*—Pillsbury Winthrop Shaw Pittman, LLP

(57) ABSTRACT

An X-ray apparatus includes a rotation-anode type X-ray tube which is configured such that a rotatable anode target and a cathode that is disposed to be opposed to the anode target are accommodated within a vacuum envelope, a stator which generates an induction electromagnetic field for rotating the anode target, a housing which accommodates and holds at least the rotation-anode type X-ray tube, a circulation path which is provided near at least a part of the rotation-anode type X-ray tube, and through which a water-based coolant is circulated, and a cooling unit including a circulation pump, which is provided at a position along the circulation path and forcibly feeds the water-based coolant, and a radiator which radiates heat of the water-based coolant, wherein an amount of dissolved oxygen at 25° C. in the water-based coolant is 5 mg/liter or less.

10 Claims, 12 Drawing Sheets

X-RAY APPARATUS

CROSS REFERENCE TO RELATED APPLICATIONS

This is a Continuation Application of PCT Application No. PCT/JP2004/015387, filed Oct. 18, 2004, which was published under PCT Article 21(2) in Japanese.

This application is based upon and claims the benefit of priority from prior Japanese Patent Application No. 2003-358276, filed Oct. 17, 2003, the entire contents of which are incorporated herein by reference.

BACKGROUND OF THE INVENTION

1. Field of the Invention

The present invention relates to an X-ray apparatus, and more particular to an X-ray apparatus with improved heat radiation characteristics relating to heat that is produced by, e.g. a rotation-anode type X-ray tube.

2. Description of the Related Art

An X-ray apparatus is configured to include a rotation-anode type X-ray tube in which a vacuum envelope accommodates an anode target that is rotatably supported, and a housing which accommodates the rotation-anode type X-ray tube. In a case where heat that is produced by, e.g. the anode target is to be radiated, the rotation-anode type X-ray tube is provided with a cooling mechanism for cooling the heat.

As regards X-ray apparatuses with cooling mechanisms, the following proposals have been made.

(1) An X-ray apparatus has been proposed, wherein a rotation-anode type X-ray tube and a stator are immersed in an insulating oil. A water-based coolant with a high heat transfer efficiency is made to flow through flow paths, which are partly provided at parts with high heat production, such as a recoil electron trap and a vacuum envelope provided near an anode target. Thereby, the parts with high heat production are cooled. The coolant is circulated between these flow paths and a cooling unit (see, e.g. U.S. Pat. No. 6,519,317).

(2) An X-ray apparatus has been proposed, which is constructed similarly to the X-ray apparatus (1), except that a rotation-anode type X-ray tube and a stator are immersed not in an insulating oil, but in a water-based coolant, and the water-based coolant is circulated between a housing and a cooling unit (see, e.g. PCT National Publication No. 2001-502473).

According to the X-ray apparatus with the structure (1), if the thermal load on the rotation-anode type X-ray tube increases, the heat that is produced from the outer surface of the vacuum envelope increases. However, since the coolant that cools the outer surface is only the insulating oil that is not cooled by the external exchanger. In some cases, the necessary cooling performance cannot be obtained. In addition, since the coolant contains water, metallic parts of the circulation paths may be corroded. The metallic parts, which constitute the flow paths that are partly provided at the recoil electron trap and vacuum envelope provided near the anode target, have functions to isolate the vacuum and the coolant. If corrosion progresses, such functions would deteriorate and the X-ray tube would become non-usable. If such a drawback occurs, the water-based coolant may enter the X-ray tube when the temperature of the anode target of the X-ray tube rises to a high level. The water-based coolant comes in contact with the high-temperature anode target, evaporates and raises pressure. This poses a problem in safety.

With the progress of corrosion, a suspended solid of a metal hydroxide, which is not dissolved in the coolant, may be produced. Consequently, the flow path of the coolant may be clogged by the suspended solid, and thermal transfer may be hindered or the flow rate may decrease. As a result, the cooling performance by the coolant may deteriorate. Furthermore, air, which is dissolved in the water-based coolant, becomes air bubbles with the rising of temperature of the water-based coolant and mixes into the water-based coolant. Thus, the cooling performance by the coolant may lower.

In addition to the problem of the structure (1), the X-ray apparatus with the structure (2) has the following problem. That is, with the decrease in insulation resistance due to the metal corrosion, the insulation performance of a low-voltage electric circuit system, such as a stator circuit, and the insulation performance between the housing and vacuum envelope may deteriorate. In particular, in the case where a dynamic-pressure slide bearing is used as the bearing of the rotational support mechanism, compared to the case where a ball bearing is used, the heat production of the stator increases and the electric insulation performance considerably deteriorates. In addition, the vacuum wall of the X-ray tube, which is not immersed in the water-based coolant in the case of (1), is corroded. As a result, a similar problem with the structure (1) tends to occur more easily.

Air, which is dissolved in the water-based coolant, becomes air bubbles with the rising of temperature of the water-based coolant and mixes into the water-based coolant. Thus, a similar problem with the structure (1) may occur. In addition, if such bubbles pass by an X-ray output window, the transmittance of produced X-rays may vary. If such a phenomenon occurs during use of the X-ray apparatus, X-ray images may disadvantageously be affected.

Besides, a return path of the water-based coolant communicates with the inner space of the housing, and thus low-voltage electric circuit systems are immersed in the water-based coolant. Such low-voltage electric circuit systems include a stator circuit system for supplying voltage to the stator and a turn-on getter circuit. Those parts of the stator circuit system, which are immersed in the water-based coolant, are a stator coil, wiring lines, and a current supply terminal for connection to an external power supply that is provided outside the housing. Those parts of the turn-on getter circuit system, which are immersed in the water-based coolant, are a current supply terminal for supplying current to the turn-on getter within the X-ray tube, wiring lines, and a current supply terminal for connection to an external power supply that is provided outside the housing.

Since the distances between current-conductive parts of these components are short, a problem of electric leak will arise due to a slight increase in electrical conduction (conductivity) of the water-based coolant. It is thus preferable to protect these structural components from the water-based coolant by integrally molding the components with resin. However, if a defect occurs in the mold due to long-time use, the water-based coolant flows into the structural parts within the mold, leading to electric leak.

Furthermore, both the housing and the vacuum envelope of the X-ray tube are set at ground potential. In order to prevent electrical noise in case of electric discharge of the X-ray tube, the X-ray tube is accommodated so as to be electrically insulated from the housing. Thus, in the case of the structure (2) wherein the return path of the water-based coolant communicates with the inner space of the housing, the water-based coolant is present near the insulating part between the housing and the X-ray tube. Since the distance for insulation is short, a problem of electric leak will arise due to a slight increase in electrical conductivity of the water-based coolant

BRIEF SUMMARY OF THE INVENTION

The present invention has been made in consideration of the above-described problems, and an object of the invention is to provide an X-ray apparatus which can prevent degradation in performance a coolant, improve heat radiation characteristics, and have high reliability for a long time.

Another object of the invention is to provide an X-ray apparatus which can prevent occurrence of failure due to degradation in performance of a coolant.

According to a first aspect of the invention, there is provided an X-ray apparatus characterized by comprising:

a rotation-anode type X-ray tube which is configured such that a rotatable anode target and a cathode that is disposed to be opposed to the anode target are accommodated within a vacuum envelope;

a stator which generates an induction electromagnetic field for rotating the anode target;

a housing which accommodates and holds at least the rotation-anode type X-ray tube;

a circulation path which is provided near at least a part of the rotation-anode type X-ray tube, and through which a water-based coolant is circulated; and a cooling unit including a circulation pump, which is provided at a position along the circulation path and forcibly feeds the water-based coolant, and a radiator which radiates heat of the water-based coolant, wherein an amount of dissolved oxygen at 25° C. in the water-based coolant is 5 mg/liter or less.

According to a second aspect of the invention, there is provided an X-ray apparatus characterized by comprising:

a rotation-anode type X-ray tube which is configured such that a rotatable anode target and a cathode that is disposed to be opposed to the anode target are accommodated within a vacuum envelope;

a stator which generates an induction electromagnetic field for rotating the anode target;

a housing which accommodates and holds at least the rotation-anode type X-ray tube;

a circulation path which is provided near at least a part of the rotation-anode type X-ray tube, and through which a water-based coolant is circulated; and a cooling unit including a circulation pump, which is provided at a position along the circulation path and forcibly feeds the water-based coolant, and a radiator which radiates heat of the water-based coolant, wherein an electrical conductivity at 25° C. of the water-based coolant is 5 mS/m or less.

According to a third aspect of the invention, there is provided an X-ray apparatus characterized by comprising:

a rotation-anode type X-ray tube which is configured such that a rotatable anode target and a cathode that is disposed to be opposed to the anode target are accommodated within a vacuum envelope;

a stator which generates an induction electromagnetic field for rotating the anode target;

a housing which accommodates and holds at least the rotation-anode type X-ray tube;

a circulation path which is provided near at least a part of the rotation-anode type X-ray tube, and through which a water-based coolant is circulated; and a cooling unit including a circulation pump, which is provided at a position along the circulation path and forcibly feeds the water-based coolant, and a radiator which radiates heat of the water-based coolant, wherein the water-based coolant contains, as an inhibitor, benzotriazole or a derivative thereof.

According to a fourth aspect of the invention, there is provided an X-ray apparatus characterized by comprising:

a rotation-anode type X-ray tube which is configured such that a rotatable anode target and a cathode that is disposed to be opposed to the anode target are accommodated within a vacuum envelope;

a stator which generates an induction electromagnetic field for rotating the anode target;

a housing which accommodates and holds at least the rotation-anode type X-ray tube;

a circulation path which is provided near at least a part of the rotation-anode type X-ray tube, and through which a water-based coolant is circulated; and a cooling unit including a circulation pump, which is provided at a position along the circulation path and forcibly feeds the water-based coolant, and a radiator which radiates heat of the water-based coolant, wherein the X-ray apparatus further comprises an impurity removing mechanism which removes impurities in the water-based coolant.

According to a fifth aspect of the invention, there is provided an X-ray apparatus characterized by comprising:

a rotation-anode type X-ray tube which is configured such that a rotatable anode target and a cathode that is disposed to be opposed to the anode target are accommodated within a vacuum envelope;

a stator which generates an induction electromagnetic field for rotating the anode target;

a housing which accommodates and holds at least the rotation-anode type X-ray tube;

a circulation path which is provided near at least a part of the rotation-anode type X-ray tube, and through which a water-based coolant is circulated; and a cooling unit including a circulation pump, which is provided at a position along the circulation path and forcibly feeds the water-based coolant, and a radiator which radiates heat of the water-based coolant, wherein the X-ray apparatus further comprises:

detection means for detecting an electrical conductivity of the water-based coolant or a physical amount that varies depending on the electrical conductivity, or a leak current of the X-ray apparatus or a physical amount that varies depending on the leak current, and generating a detection signal; and control means for executing, based on the detection signal of the detection means, a control to prohibit or permit an X-ray output operation by the rotation-anode type X-ray tube.

DETAILED DESCRIPTION OF THE INVENTION

X-ray apparatuses according to embodiments of the present invention will now be described with reference to the accompanying drawings. To begin with, first to sixth embodiments of X-ray apparatuses, to which the present invention is applicable, are described.

First Embodiment

Figure 1:
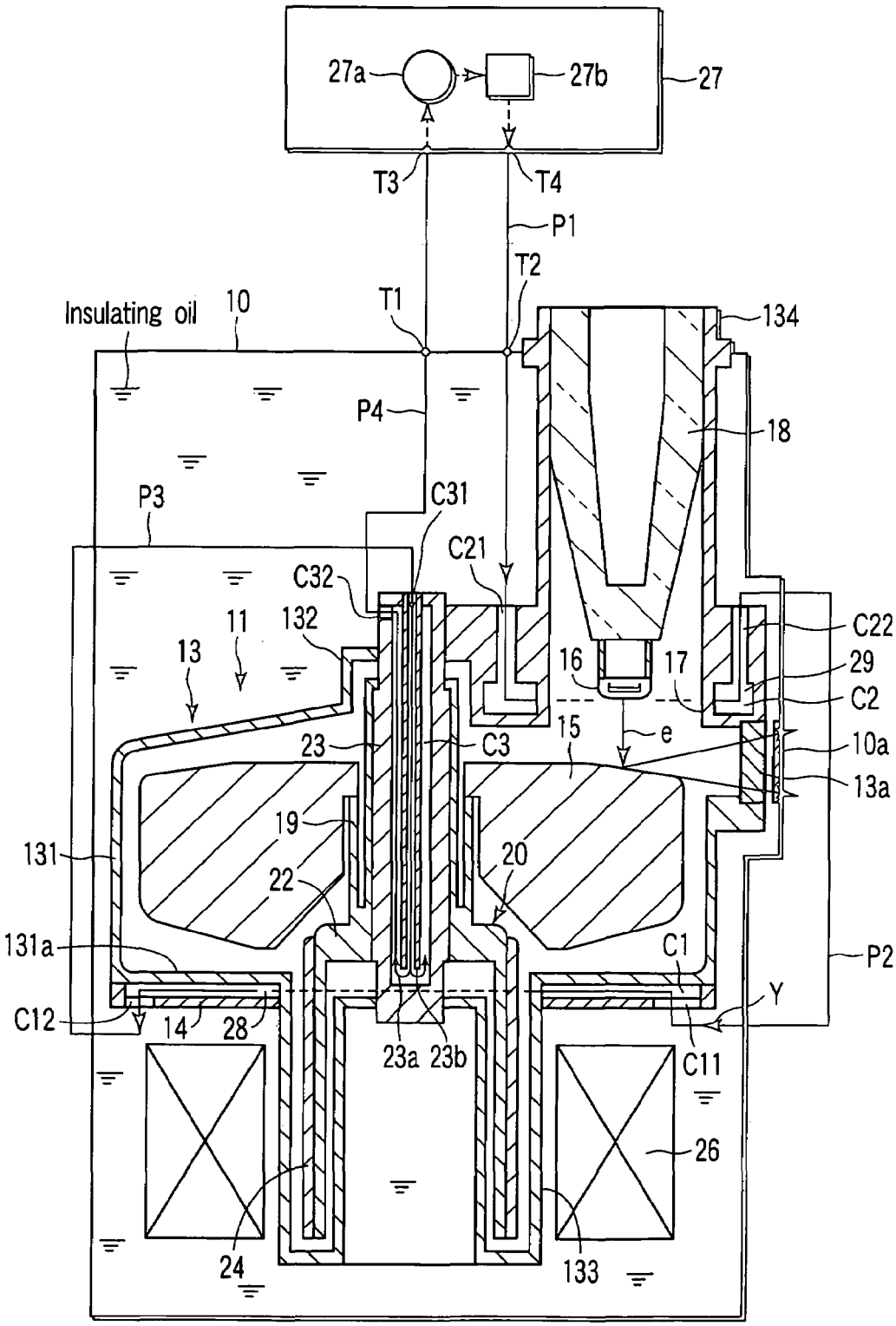
FIG. 1 schematically shows the structure of an X-ray apparatus according to a first embodiment of the present invention.

As is shown in FIG. 1, an X-ray apparatus according to a first embodiment includes a housing 10 and a rotation-anode type X-ray tube 11. The housing 10 has an X-ray output window 10*a* provided at a part thereof. The rotation-anode type X-ray tube 11 is accommodated and held within the housing 10. The housing 10 contains a non-water-based coolant, such as an insulating oil, that fills its inner space accommodating the rotation-anode type X-ray tube 11.

The rotation-anode type X-ray tube 11 is composed of a vacuum envelope 13, etc. The vacuum envelope 13 has an X-ray output window 13*a* provided at a part thereof. The vacuum envelope 13 is composed of, for example, a large-diameter portion 131, a small-diameter portion 132 with a less diameter than the large-diameter portion 131, a double-cylindrical portion 133 and a cylindrical cathode-containing portion 134. The large-diameter portion 131, small-diameter portion 132 and cylindrical portion 133 are provided coaxial with the tube axis. The cathode-containing portion 134 is provided eccentric from the tube axis.

A rotatable anode target 15 is disposed in the large-diameter portion 121. A cathode 16 is disposed in the cathode-containing portion 134 so as to face the anode target 15. A recoil electron trap (shield structure) 17 is provided at a part of the cathode-containing portion 134, for example, at a wall part that is so disposed as to surround the cathode 16. The recoil electron trap 17 captures electrons which are reflected from the anode target 15. The recoil electron trap 17 is formed of a material with a relatively high heat conductivity, such as copper or a copper alloy.

The cathode 16 is supported by a cathode support structure 18. The cathode support structure 18 is fixed to the inside of the cathode-containing portion 134. The anode target 15 is coupled to a rotational support mechanism 20 via a coupling portion 19, and is rotatably supported by the rotational support mechanism 20.

The rotational support mechanism 20 comprises a rotary member 22, which is coupled to the coupling portion 19, and a stationary member 23 which is fitted, for example, in a distal-end portion of the rotary member 22. A cylindrical rotor 24 is coupled to an outer peripheral surface of a rear-end cylindrical portion of the rotary member 22. A dynamic-pressure slide bearing, for instance, a radial-directional/thrust-directional dynamic-pressure slide bearing (not shown), is provided at an engaging part between the rotary member 22 and stationary member 23. Both end portions of the stationary member 23 are fixed to the vacuum envelope 13.

A stator 26 is disposed outside the vacuum envelope 13, for example, at such a position as to surround the cylindrical rotor 24. The stator 26 generates an induction electromagnetic field for rotating the anode target 15. The stator 26, together with the rotation-anode type X-ray tube 11, is accommodated within the housing 10 and is put in contact with the insulating oil.

A cooling unit 27 is provided, for example, outside the housing 10. The cooling unit 27 comprises, for example, a circulation pump 27*a* and a heat exchanger 27*b*. The circulation pump 27*a* is provided at a point on a circulation path through which a water-based coolant (to be described later) is circulated. The circulation pump 27*a* forcibly feeds the water-based coolant. The heat exchanger (radiator) 27*b* is provided on a downstream side of the circulation pump 27*a* and radiates heat of the water-based coolant. The radiator is formed of a material with a relatively high heat conductivity, such as copper or a copper alloy. The water-based coolant is, for instance, is a coolant with a higher heat conductivity than the insulating oil in the housing 10, such as a mixture of water and ethylene glycol or propylene glycol (hereinafter referred to as "antifreeze liquid"). The water-based coolant is filled in the circulation path.

The circulation path of the water-based coolant is provided in the vicinity of at least a part of the rotation-anode type X-ray tube 11. The circulation path includes a first cooling path C1, a second cooling path C2 and a third cooling path C3. The first cooling C1 is formed on the cylindrical portion 133 side of the large-diameter portion 131, that is, under the large-diameter portion 131. The second cooling path C2 is formed near or within the recoil electron trap 17. The third cooling path C3 is formed within the stationary member 23.

Specifically, on the outside of a wall 131*a* located on the cylindrical portion 133 side of the large-diameter portion 131, an annular wall 14 is so provided as to be in parallel to the wall 131*a* and to surround the cylindrical portion 133. The first cooling path C1 is a discoidal space 28 provided between the wall 131*a* and the wall portion 14. The discoidal space 28 includes an inlet C11 for introducing the water-based coolant into the first cooling path C1, and an outlet C12 for draining the water-based coolant from the first cooling path C1. The inlet C11 and outlet C12 are formed, for example, at both ends of the discoidal space 28 with respect to the center of the discoidal space 28 (i.e. at a distance of 180°).

The second cooling path C2 is, for instance, an annular space 29 within the recoil electron trap 17. The annular space 29 includes an inlet C21 for introducing the water-based coolant into the second cooling path C2, and an outlet C22 for draining the water-based coolant from the second cooling path C2.

The third cooling path C3 is formed of, for instance, a cavity 23*a* which is formed within the stationary member 23, and a pipe 23*b* which is inserted in the cavity 23*a*. Specifically, the stationary member 23 is a hollow rod-like member having one end portion (on the cathode-containing portion 134 side in this example) opened, and the other end portion (on the cylindrical rotor 24 side in this example) closed. The pipe 23*b* is fixed at the rotational center of the cylindrical rotor 24. One end of the pipe 23*b*, which corresponds to the above-mentioned one end portion of the stationary member 23, serves as an inlet C31 for introducing the water-based coolant into the third cooling path C3. The above-mentioned one end portion of the stationary member 23 serves as an outlet C32 for draining the water-based coolant from the third cooling path C3. To be more specific, the water-based coolant, which is introduced from the inlet C31, flows through the pipe 23*b* and turns in a U-shape within the cavity 23*a*, and then the water-based coolant is drained from the outlet C32 to the outside of the stationary member 23.

Pipes P1, P2, P3 and P4 connect, respectively, the cooling unit 27 and inlet C21, the outlet C22 and inlet C11, the outlet C12 and inlet C31, and the outlet C32 and cooling unit 27. Thereby, the circulation path including the first cooling path C1, second cooling path C2 and third cooling path C3 is formed. For the convenience of depiction, the pipes P2 and P3 are partly depicted on the outside of the housing 10. Normally, however, the pipes P2 and P3 are provided within the housing 10.

The cooling unit 27 is connected to the housing 10 via detachable piping joints. Specifically, circulation paths between the housing 10 and cooling unit 27 are formed of, e.g. hoses. Connection parts T1 and T2 between the hoses and the housing 10 and connection parts T3 and T4 between the hoses and the cooling unit 27 are configured such that at least the connection parts on the housing 10 side or the connection parts on the cooling unit 27 side are detachable. With this structure, the housing 10 and the cooling unit 27 can be separated, and the work for installing the cooling unit 27 and the work for maintenance are made easier.

In the X-ray apparatus with the above-described structure, the rotary member 22 is rotated by an induction electromagnetic field that is generated by the stator 26. The rotational force is transmitted to the anode target 15 via the coupling portion 19, and the anode target 15 is rotated. In this state, an electron beam e is radiated from the cathode 16 to the anode target 15, and the anode target 15 emits X-rays. The X-rays are extracted to the outside via the X-ray output windows 13*a* and 10*a*. At this time, part of the electron beam e, which is reflected by the anode target 15, is captured by the recoil electron trap 17.

If the rotation-anode type X-ray tube 11 is set in operation, the temperature of the anode target 15 rises due to the irradiation with the electron beam e. The temperature of the recoil electron trap 17 also rises due to the capture of the reflective electron beam e from the anode target 15. Further, the temperature of the stator 26 rises due to electric current flowing in the coil section. By the transfer of the heat, the temperature of the vacuum envelope 13 rises.

The heat of the vacuum envelope 13 and stator 26 is transferred to the insulating oil within the housing 10 and thus radiated to the outside. The heat of the anode target 15 and recoil electron trap 17 is transferred to the antifreeze liquid circulating in the circulation path and is radiated to the outside. Specifically, the circulation pump 27*a* of the cooling unit 27 circulates the antifreeze liquid in the circulation path, as indicated by an arrow Y in the Figure. The heat exchanger 27*b* radiates heat of the antifreeze liquid, which is forcibly fed from the circulation pump 27*a* and has the temperature raised by cooling the rotation-anode type X-ray tube 11.

The antifreeze liquid, which is fed out of the heat exchanger 27*b* of the cooling unit 27, is introduced into the inlet C21 via the pipe P1 and cools the recoil electron trap 17 while passing through the annular space 29 (second cooling path C2). The antifreeze liquid coming out of the outlet C22 is introduced into the inlet C11 via the pipe P2 and cools the large-diameter portion 131 of the vacuum envelope 13 while passing through the discoidal space 28 (first cooling path C1).

The antifreeze liquid drained from the outlet C12 is introduced into the inlet C31 via the pipe P3 and cools the stationary member 23 while passing through the cavity 23*a* (third cooling path C3) that is so formed as to permit reciprocal flow of the antifreeze liquid within the stationary member 23. The antifreeze liquid coming out of the outlet C32 is returned to the cooling unit 27 via the pipe P4.

According to the X-ray apparatus of the first embodiment, the heat of the parts, the temperature of which rises to a high level, such as parts of the recoil electron trap 17 and vacuum envelope 13, is efficiently radiated by the antifreeze liquid with high thermal transfer efficiency, which flows through the first cooling path C1, second cooling path C2 and third cooling path C3. At the large-diameter portion 131, heat exchange is performed between the antifreeze liquid flowing in the first cooling path C1 and the insulating oil. In this case, the insulating oil moves while being in contact with the outer surface of the wall portion 14, and thus efficient heat exchange is performed with the antifreeze liquid and the characteristics of heat radiation by the insulating oil are improved. As a result, there is no need to provide a heat exchanger for the insulating oil, and the structure of the apparatus is simplified.

Furthermore, the outer periphery of the stator 26, the outer surface of the vacuum envelope 13 and the inner surface of the housing 10 are not in contact with the water-based coolant, and the insulating oil flow along them. It is thus possible to prevent a decrease in electrical insulation and corrosion of metal.

Therefore, it is possible to provide an X-ray apparatus which can secure good heat radiation characteristics and high reliability for a long time.

Second Embodiment

An X-ray apparatus according to a second embodiment of the present invention is described. The structural parts common to those in the first embodiment are denoted by like reference numerals, and a detailed description is omitted.

Figure 2:
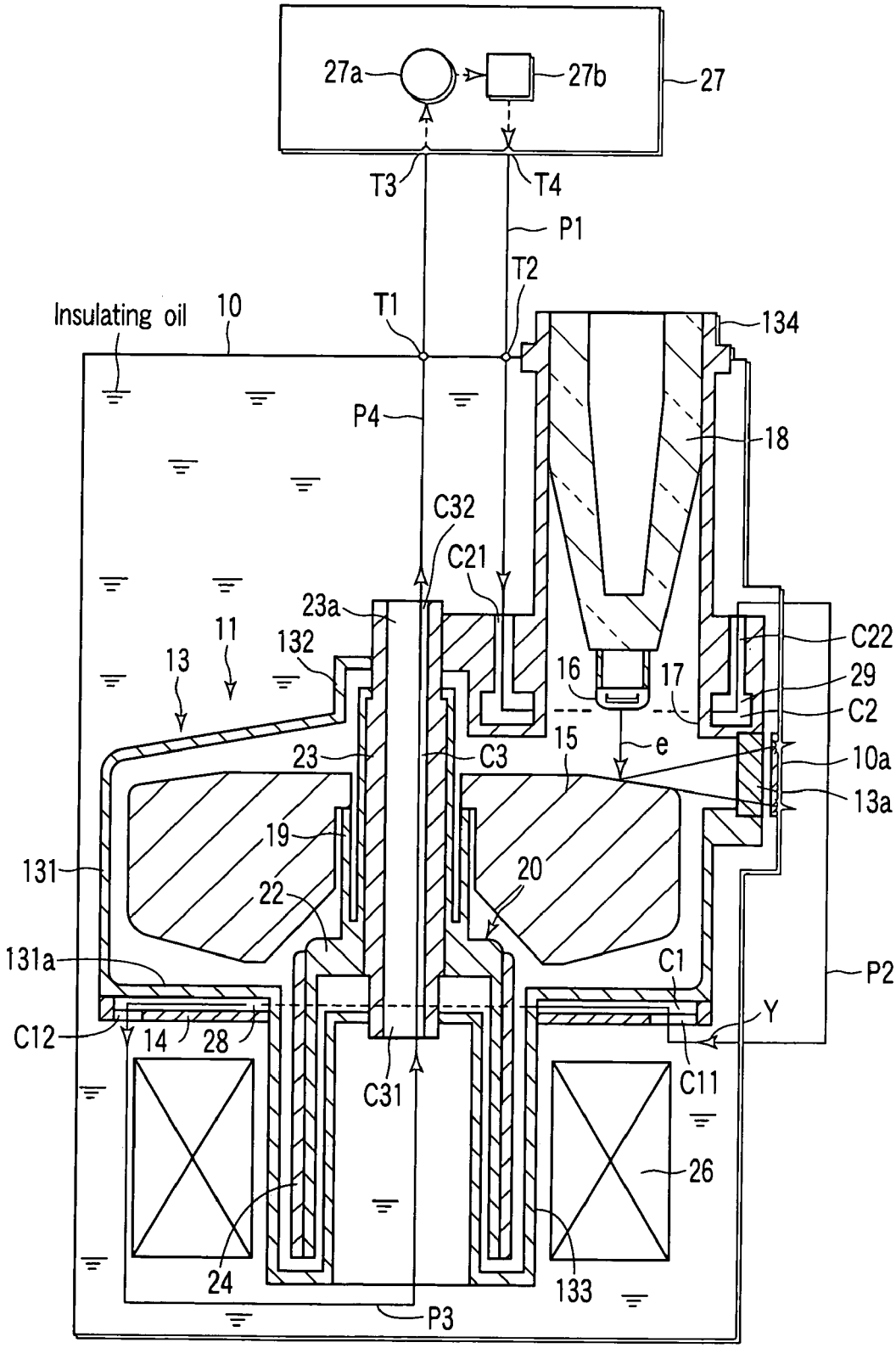
FIG. 2 schematically shows the structure of an X-ray apparatus according to a second embodiment of the invention.

As is shown in FIG. 2, the third cooling path C3 is formed, for example, by a through-hole 23*a* that linearly penetrates the stationary member 23. The stationary member 23 is a hollow rod-like member, and has both ends opened. The through-hole 23*a* includes an inlet C31 for introducing the water-based coolant into the third cooling path C3, and an outlet C32 for draining the water-based coolant from the third cooling path C3. The inlet C31 is provided at the above-mentioned other end portion (on the cylindrical rotor 24 side in this example) of the stationary member 23. The outlet C32 is provided at the above-mentioned one end portion (on the cathode-containing portion 134 side in this example) of the stationary member 23.

Pipes P1, P2, P3 and P4 connect, respectively, the cooling unit 27 and inlet C21, the outlet C22 and inlet C11, the outlet C12 and inlet C31, and the outlet C32 and cooling unit 27. Thereby, the circulation path including the first cooling path C1, second cooling path C2 and third cooling path C3 is formed. For the convenience of depiction, the pipe P2 is partly depicted on the outside of the housing 10. Normally, however, all the pipes are provided within the housing 10.

The X-ray apparatus with the above-described structure is configured such that the antifreeze liquid coming out of the outlet C12 is introduced into the inlet C31 via the pipe P3 and cools the stationary member 23 while passing through the through-hole 23*a* (third cooling path C3) that extends within the stationary member 23 in one direction (i.e. direction from the cylindrical rotor 24 side toward the cathode-containing portion 134 side).

According to the X-ray apparatus of the second embodiment, the same advantages as with the first embodiment can be obtained.

Third Embodiment

An X-ray apparatus according to a third embodiment of the present invention is described. The structural parts common to those in the first embodiment are denoted by like reference numerals, and a detailed description is omitted.

Figure 3:
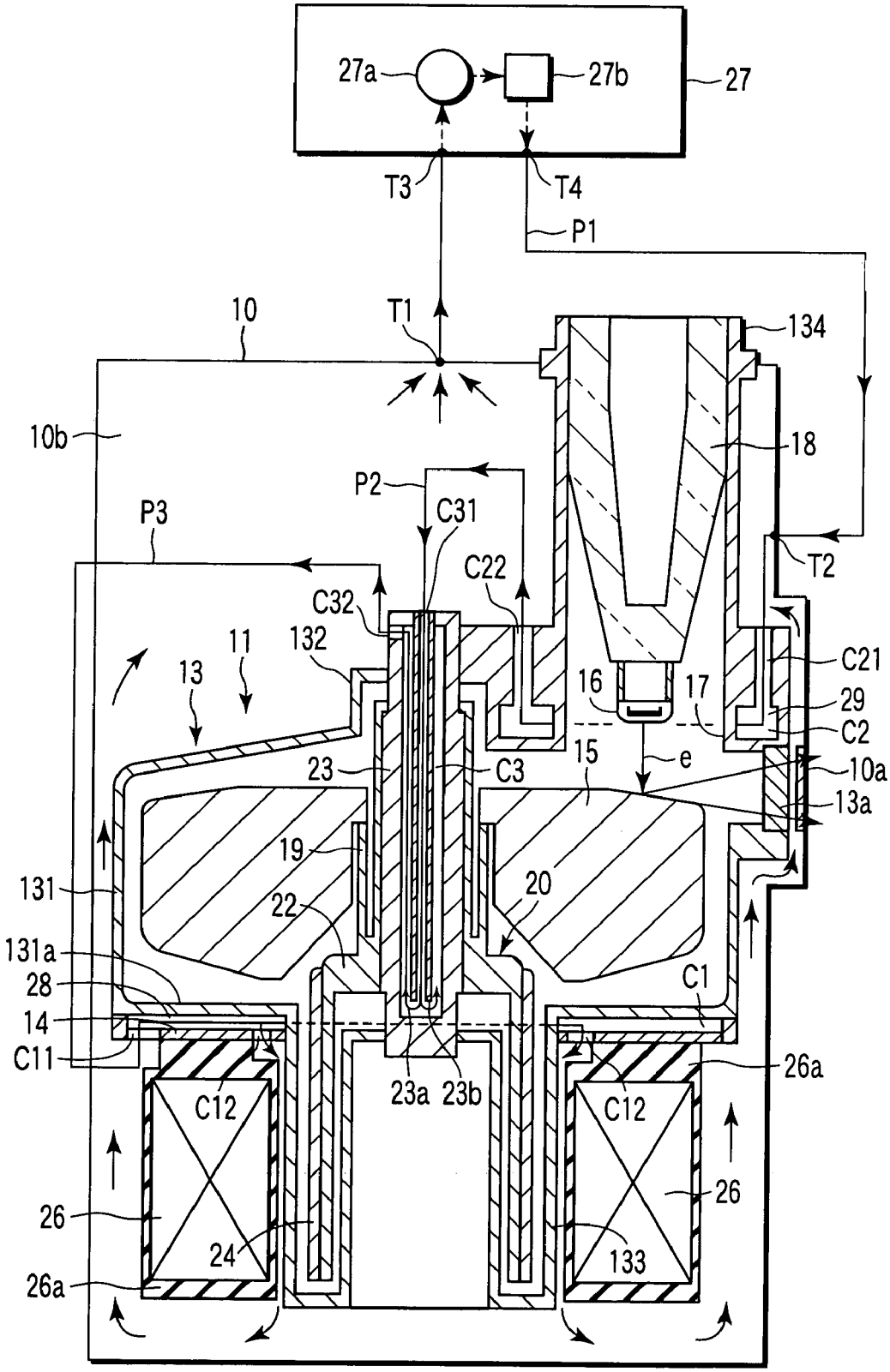
FIG. 3 schematically shows the structure of an X-ray apparatus according to a third embodiment of the invention.

As is shown in FIG. 3, like the first embodiment, the third cooling path C3 is formed of, for instance, a cavity 23*a* which is formed within the stationary member 23, and a pipe 23*b* which is inserted in the cavity 23*a*. Specifically, an inlet C31 for introducing the water-based coolant into the third cooling path C3 and an outlet C32 for draining the water-based coolant from the third cooling path C3 are both provided at one end portion of the stationary member 23 (on the cathode-containing portion 134 side in this example).

Pipes P1, P2 and P3 connect, respectively, the cooling unit 27 and inlet C21, the outlet C22 and inlet C31, and the outlet C32 and inlet C11. The outlet C12 drains the antifreeze liquid, which is introduced into the first cooling path C1, into an inner space 10*b* of the housing 10. The connection part T1 between the hose and the housing 10 functions as an outlet for outputting the antifreeze liquid from the inner space 10*b* of the housing 10 to the cooling unit 27 via the hose.

A return path of the antifreeze liquid is formed between the inner space 10*b* of the housing 10 and the cooling unit 27 (i.e. between the connection parts T1 and T3). Thus, the inner space 10*b*, which accommodates the rotation-anode type X-ray tube 11, is filled with the antifreeze liquid that is the water-based coolant.

A circulation path of the antifreeze liquid is so formed as to include the pipes P1, P2 and P3, the first cooling path C1, second cooling path C2, third cooling path C3, and the return path. For the convenience of depiction, the pipes P1 and P3 are partly depicted on the outside of the housing 10. Normally, however, the pipes P1 and P3 are provided within the housing 10.

On the other hand, the stator 26, together with the rotation-anode type X-ray tube 11, is accommodated within the housing 10. Since the stator 26 is put in contact with the water-based coolant, an anti-rust coating film 26*a* is formed (by molding) on at least a part of the surface of the stator 26.

The anti-rust coating film 26*a* is formed of, e.g. an organic coating film. To be more specific, the organic coating film is formed of a thick coating film of a resin selected from an epoxy resin, a tar epoxy resin, a polyimide resin, an acrylic resin, a fluoro-resin, a silicone resin and a polyurethane resin, or a mixture resin essentially comprising this resin.

Thereby, the periphery of the stator 26 does not come in contact with the water-based coolant, and degradation in electrical insulation can be prevented.

In the X-ray apparatus with the above-described structure, the heat of the vacuum envelope 13, stator 26, anode target 15 and recoil electron trap 17 is transferred to the antifreeze liquid circulating in the circulation path and is radiated to the outside. Specifically, the circulation pump 27*a* of the cooling unit 27 circulates the antifreeze liquid in the circulation path, as indicated by an arrow Y in the Figure. The heat exchanger 27*b* radiates heat of the antifreeze liquid, which is forcibly fed from the circulation pump 27*a* and has the temperature raised by cooling the rotation-anode type X-ray tube 11.

The antifreeze liquid, which is fed out of the heat exchanger 27*b* of the cooling unit 27, is introduced into the inlet C21 via the pipe P1 and cools the recoil electron trap 17 while passing through the annular space 29 (second cooling path C2). The antifreeze liquid coming out of the outlet C22 is introduced into the inlet C31 via the pipe P2 and cools the stationary member 23 while passing through the cavity 23*a* (third cooling path C3) that is so formed as to permit reciprocal flow of the antifreeze liquid within the stationary member 23.

The antifreeze liquid coming out of the outlet C32 is introduced into the inlet C11 via the pipe P3 and cools the large-diameter portion 131 of the vacuum envelope 13 while passing through the discoidal space 28 (first cooling path C1). The antifreeze liquid drained from the outlet C12 is drained into the inner space 10*b* of the housing 10, and cools the vacuum envelope 13 and stator 26. The antifreeze liquid in the inner space 10*b* is returned to the cooling unit 27 via the connection part T1.

According to the X-ray apparatus of the third embodiment, the same advantageous effects as with the first embodiment can be obtained. In addition, since the coolant to be used is only the water-based coolant, this is advantageous in terms of cost, and the maintenance is easy. Since the water-based coolant has a higher heat transfer efficiency than the insulating oil, the heat radiation characteristics of the entire apparatus can further be improved.

Fourth Embodiment

An X-ray apparatus according to a fourth embodiment of the present invention is described. The structural parts common to those in the third embodiment are denoted by like reference numerals, and a detailed description is omitted.

Figure 4:
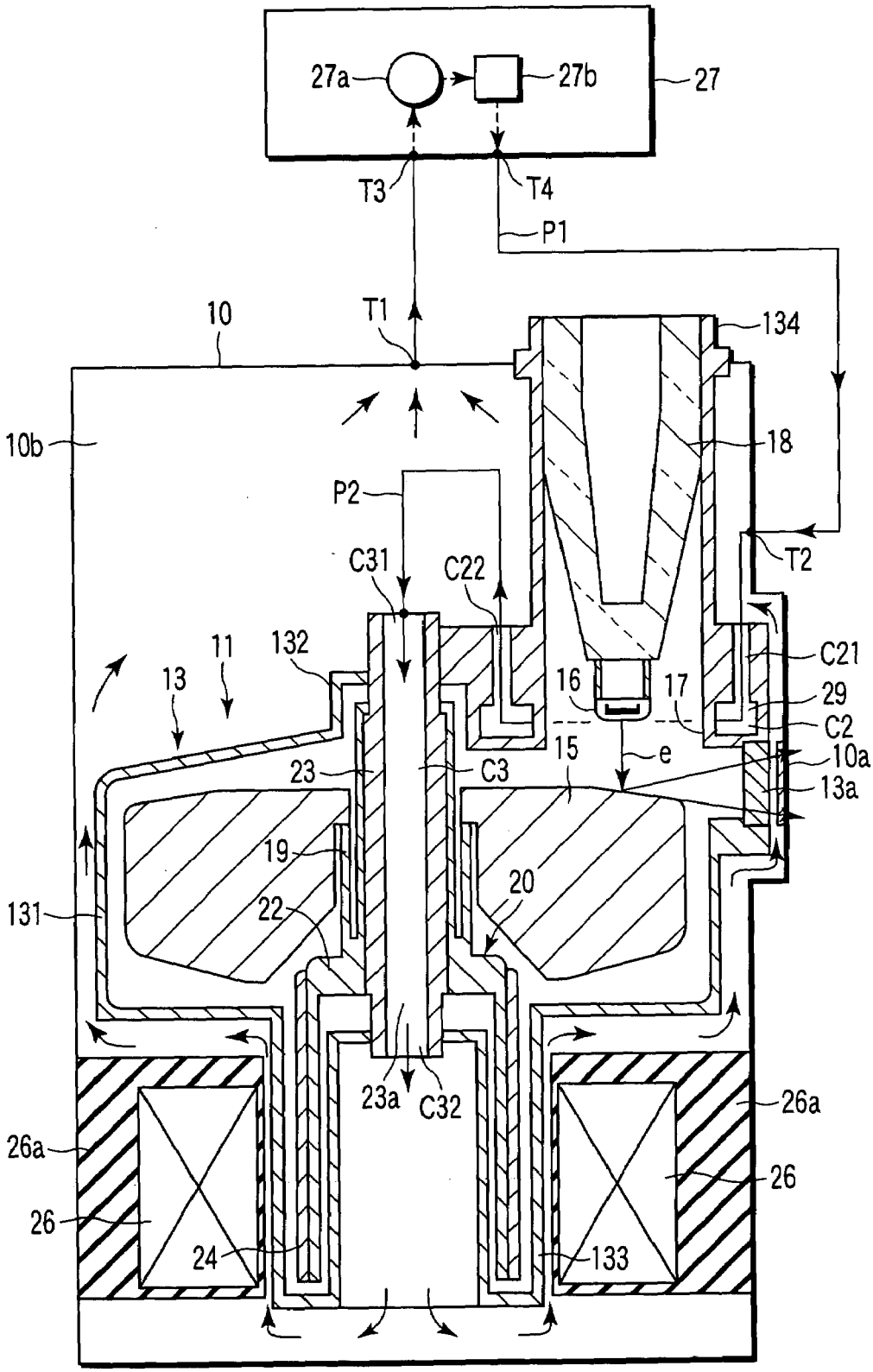
FIG. 4 schematically shows the structure of an X-ray apparatus according to a fourth embodiment of the invention.

As is shown in FIG. 4, like the second embodiment, the third cooling path C3 is formed by a through-hole 23*a* that linearly penetrates the stationary member 23. The stationary member 23 is a hollow rod-like member, and has both ends opened. The through-hole 23*a* includes an inlet C31 for introducing the water-based coolant into the third cooling path C3, and an outlet C32 for draining the water-based coolant from the third cooling path C3. The inlet C31 is provided at one end portion (on the cathode-containing portion 134 side in this example) of the stationary member 23. The outlet C32 is provided at the other end portion (on the cylindrical rotor 24 side in this example) of the stationary member 23.

Pipes P1 and P2 connect, respectively, the cooling unit 27 and inlet C21, and the outlet C22 and inlet C31. The output C32 drains the antifreeze liquid, which is introduced into the third cooling path C3, into the inner space 10*b* of the housing 10. The connection part T1 between the hose and the housing 10 functions as an outlet for outputting the antifreeze liquid from the inner space 10*b* of the housing 10 to the cooling unit 27 via the hose.

A return path of the antifreeze liquid is formed between the inner space 10*b* of the housing 10 and the cooling unit 27 (i.e. between the connection parts T1 and T3). Thus, the inner space 10*b*, which accommodates the rotation-anode type X-ray tube 11, is filled with the antifreeze liquid that is the water-based coolant.

A circulation path of the antifreeze liquid is so formed as to include the pipes P1 and P2, the second cooling path C2, the third cooling path C3, and the return path. For the convenience of depiction, the pipe P1 is partly depicted on the outside of the housing 10. Normally, however, all the pipes are provided within the housing 10.

On the other hand, like the third embodiment, the stator 26, together with the rotation-anode type X-ray tube 11, is accommodated within the housing 10, and an anti-rust coating film 26*a* is formed (by molding) on at least a part of the surface of the stator 26. Thereby, the periphery of the stator 26 does not come in contact with the water-based coolant, and degradation in electrical insulation can be prevented.

The X-ray apparatus with the above-described structure is configured such that the antifreeze liquid coming out of the outlet C22 is introduced into the inlet C31 via the pipe P2 and cools the stationary member 23 while passing through the through-hole 23*a* (third cooling path C3) that extends within the stationary member 23 in one direction (i.e. direction from the cathode-containing portion 134 side to the cylindrical rotor 24 side).

According to the X-ray apparatus of the fourth embodiment, the same advantages as with the third embodiment can be obtained.

Fifth Embodiment

An X-ray apparatus according to a fifth embodiment of the present invention is described. The structural parts common to those in the third embodiment are denoted by like reference numerals, and a detailed description is omitted.

Figure 5:
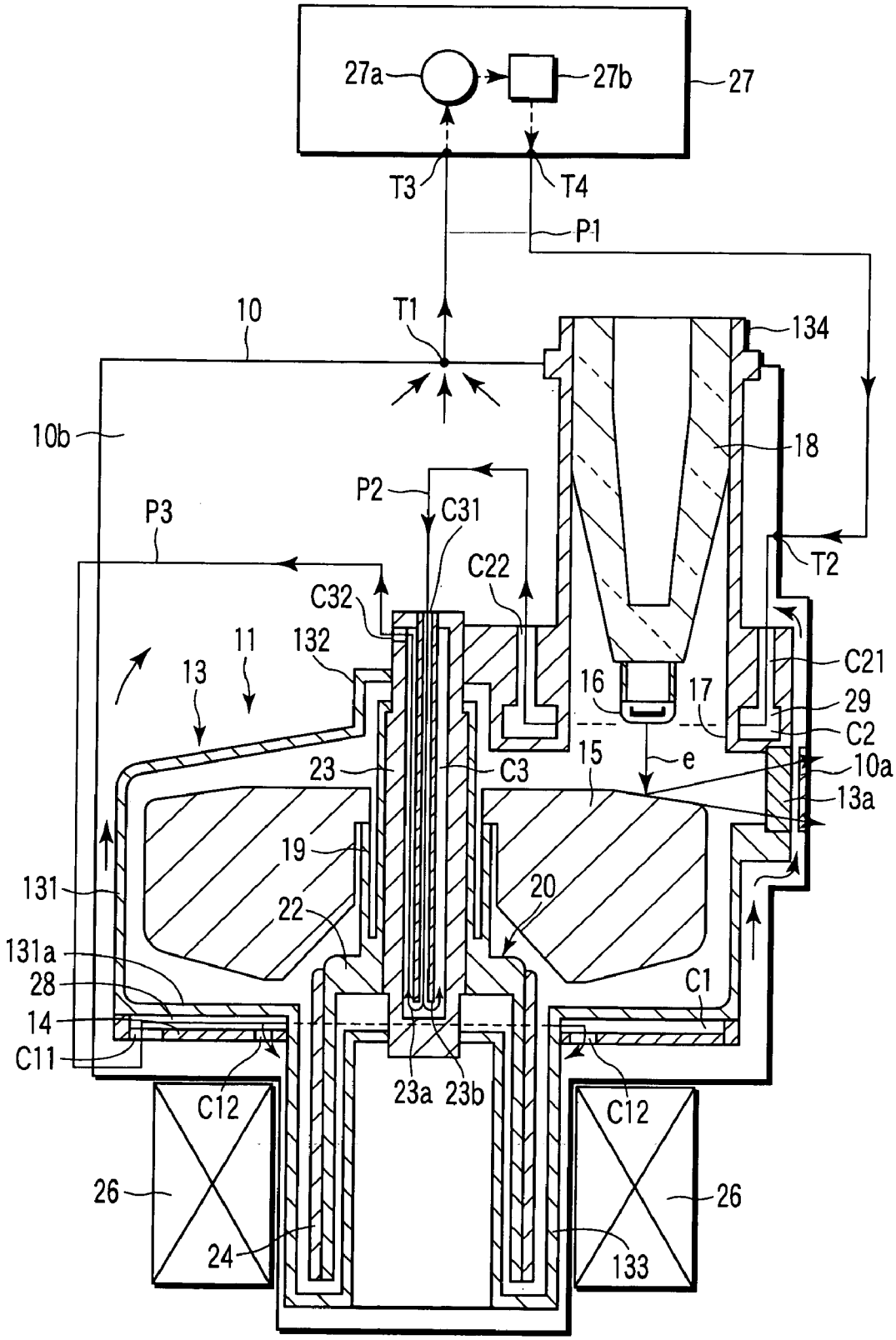
FIG. 5 schematically shows the structure of an X-ray apparatus according to a fifth embodiment of the invention.

As is shown in FIG. 5, the X-ray apparatus according to the fifth embodiment has basically the same structure as the X-ray apparatus according to the third embodiment shown in FIG. 3. The fifth embodiment, however, differs from the third embodiment in that the stator 26 is disposed outside the housing 10. Since the stator 26 does not come in contact with the water-based coolant, degradation in electrical insulation can be prevented. Unlike the third embodiment, there is no need to form an anti-rust coating film on the surface of the stator 26. Thus, the cost can be reduced and the size of the entire apparatus can advantageously be reduced. The stator 26 with this structure cannot be cooled by the coolant, but it can be cooled by making use of outside air.

According to the X-ray apparatus of the fifth embodiment, the same advantages as with the third embodiment can be obtained.

Sixth Embodiment

An X-ray apparatus according to a sixth embodiment of the present invention is described. The structural parts common to those in the fourth embodiment are denoted by like reference numerals, and a detailed description is omitted.

Figure 6:
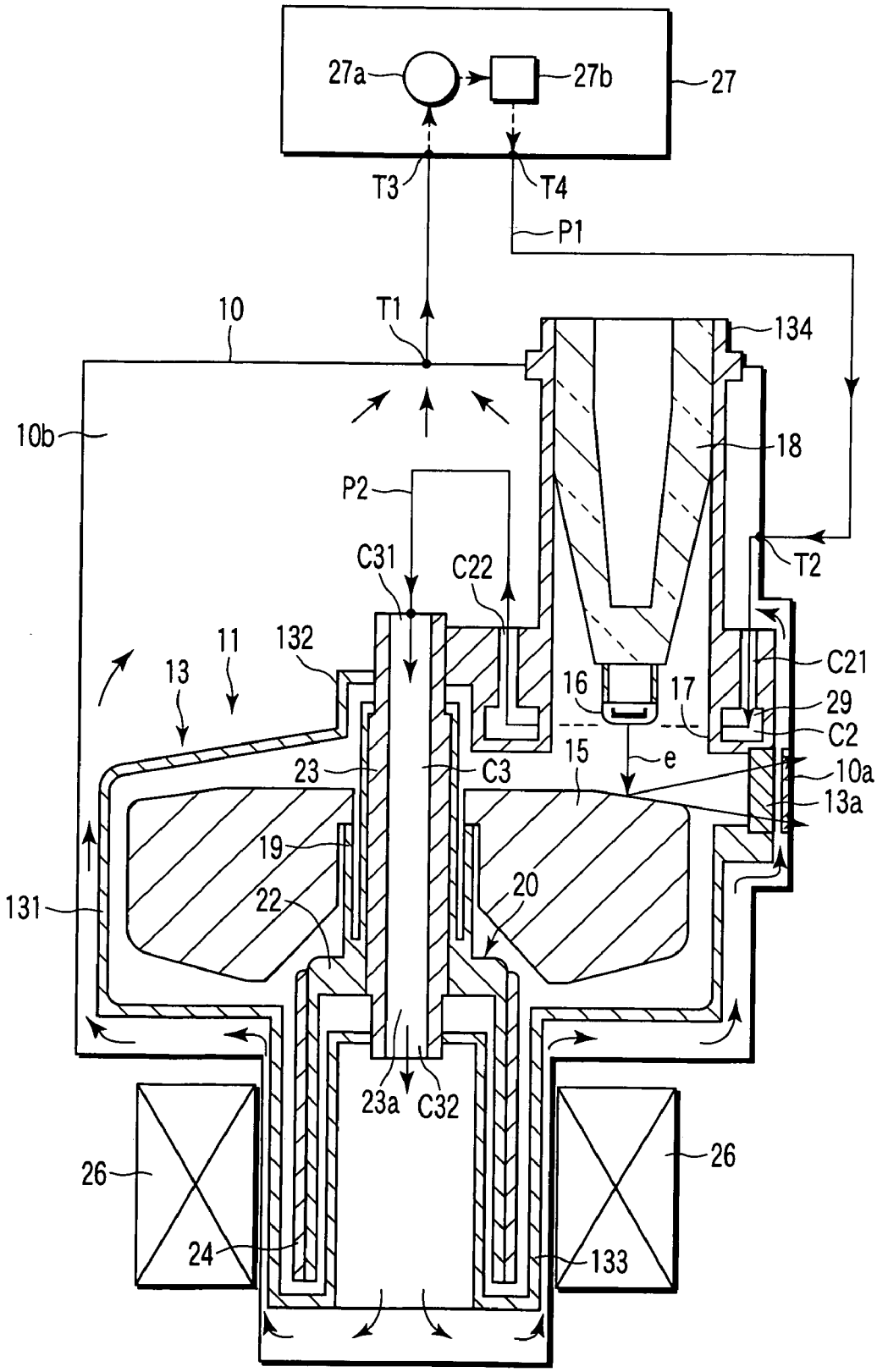
FIG. 6 schematically shows the structure of an X-ray apparatus according to a sixth embodiment of the invention.

As is shown in FIG. 6, the X-ray apparatus according to the sixth embodiment has basically the same structure as the X-ray apparatus according to the fourth embodiment shown in FIG. 4. The sixth embodiment, however, differs from the fourth embodiment in that the stator 26 is disposed outside the housing 10. Since the stator 26 does not come in contact with the water-based coolant, degradation in electrical insulation can be prevented. Unlike the fourth embodiment, there is no need to form an anti-rust coating film on the surface of the stator 26. Thus, the cost can be reduced and the size of the entire apparatus can advantageously be reduced. The stator 26 with this structure cannot be cooled by the coolant, but it can be cooled by making use of outside air.

According to the X-ray apparatus of the sixth embodiment, the same advantages as with the fourth embodiment can be obtained.

(Re: Electrochemical Corrosion)

In each of the above-described embodiments, it is possible that the metal parts of the X-ray apparatus, which are immersed in the water-based coolant, are electrochemically corroded. Specifically, in the liquid with electrical conductivity, such as the water-based coolant, a certain portion of the metal part functions as an anode (with a relatively lower potential) and another portion of the metal part functions as a cathode (with a relatively higher potential). The anode reaction and cathode reaction at the respective portions are associated. That is, a cell is constituted.

The anode reaction and cathode reaction are expressed as follows. Both reactions progress while they are always associated with each other. In the formulae below, n is an integer.

Anode reaction: $M \rightarrow M^{n+} + ne^-$ (metal becomes an ion)

Cathode reaction 1: $ne^- + nH^+ + \rightarrow nH$, $nH \rightarrow (n/2)\ H_2$ (a hydrogen ion releases electricity and becomes a hydrogen atom, and the hydrogen atom becomes hydrogen gas)

Cathode reaction 2: $ne^- + (n/4)O_2 + (n/2)H_2O \rightarrow nOH^-$ (dissolved oxygen in liquid becomes a hydroxide ion)

When the anode reaction and cathode reaction 1 progress in combination, the following chemical reaction will progress:

$$M + nH^+ M^{n+} + (n/2)H_2 \quad (1)$$

When the anode reaction and cathode reaction 2 progress in combination, the following chemical reaction will progress:

$$M + (n/4)O_2 + (n/2)H_2O \rightarrow Mn^+ + nOH^- \quad (2)$$

By the progress of the chemical reactions of reaction formulae (1) and (2), metallic parts of the anode and cathode are eluted as metal ions. In other words, the metallic parts in the water-based coolant are gradually corroded (electrochemical corrosion). In the first and second embodiments, the metallic parts, which are disposed along the circulation path of the water-based coolant, such as the circulation pump 27*a*, heat exchanger 27*b*, pipes P1 to P4, cooling paths C1 to C3 and connection parts T1 to T4, may possibly be electrochemically corroded. In the third to sixth embodiments, in addition to the above-mentioned metallic parts, the inner surface of the housing 10, the outer surface of the vacuum envelope 13, stator 26 and parts of various circuit systems may possibly be electrochemically corroded.

(First Reaction Suppressing Method for Electrochemical Corrosion)

With the progress of the chemical reactions of chemical formulae (1) and (2), the metal ion concentration in the liquid increases. It is thus understood that there is the problem that the electrical conductivity of the liquid (corresponding to the inverse number of electrical resistivity) increases. The increase in electrical conductivity of the liquid promotes corrosion of metallic parts, and also may cause electrical leak.

A reference document relating to the relationship between the electrical conductivity of liquid and the corrosion of metal is Shadan-Hojin, Nihon Bousei Gijyutsu Kyokai, "Bousei Gijyutsusha No Tameno Denki-kagaku Nyumon, Oyobi Saishin Bousei Boushoku Gijyutsu (Manual of Electrochemistry for Anti-rust Engineers and Latest Anti-rust Anti-corrosion Techniques)", which describes the relationship between the corrosive property of soil on iron and electrical resistivity. According to this document, when the electrical resistivity of soil is ρ(Ω·cm), the corrosiveness of metal is as follows:

ρ<900 ⇒very high corrosiveness,

ρ=900 to 2300⇒ relatively high corrosiveness,

ρ=2300 to 5000⇒ moderate corrosiveness,

ρ=5000 to 10000⇒ low corrosiveness, and

ρ>10000 ⇒very low corrosiveness.

The constituent material of those parts of the X-ray apparatus of the present invention, which are in contact with the water-based coolant, include an iron alloy, such as steel, as one of most corrodible metals. In order to extremely reduce the corrosiveness of the part of the X-ray apparatus, which is in contact with the water-based coolant, it is estimated that the electrical resistivity of the water-based coolant should be 20000 Ω·cm or more, in other words, the electrical conductivity should be (1/20000) S/cm=5 mS/m or less.

With the progress of corrosion as indicated by reaction formula (1), hydrogen gas occurs. Since the hydrogen gas mixes into the water-based coolant, the cooling performance may deteriorate, the strength of metallic parts may lower, or the hydrogen gas which occurs near the X-ray output window may adversely affect X-ray images. Further, with the progress of corrosion, the metal ion and hydroxide ion may react and a suspended product of an insoluble metal hydroxide may be produced in the water-based coolant.

It is thus effective to set the electrical conductivity of the water-based coolant, which is initially introduced in the circulation path in the manufacturing process of the X-ray apparatus, at a low level, and also to keep the electrical conductivity at a low level during use of the X-ray apparatus. Specifically, it is preferable to set the water-based coolant at a substantially electrically insulating state, and to set the electrical conductivity at 5 mS/m or less.

The above-described electrical conductivity can be measured by a digital resistivity meter MH-7 (manufactured by ORGANO Corporation). The measurement value obtained by this meter is electrical resistivity (Ω·cm), but the electrical conductivity (S/cm) is an inverse number of the resistivity.

(Second Reaction Suppressing Method for Electrochemical Corrosion)

The presence of dissolved oxygen is associated with the progress of the chemical reaction as indicated by reaction formula (2). Thus, in a second reaction suppression method for suppressing a corrosion reaction, it is effective to set the amount of dissolved oxygen in the water-based coolant, which is initially introduced in the circulation path in the manufacturing process of the X-ray apparatus, at a low level, and also to keep the amount of dissolved oxygen at a low level during use of the X-ray apparatus. Specifically, it is preferable to set the amount of dissolved oxygen in the water-based coolant at normal temperature (25° C.) to be less than a saturation amount (about 8 mg/liter) at normal temperature/normal pressure (1 atm), and it is more preferable to set the amount of dissolved oxygen at 5 mg/liter or less.

For example, the saturation amount of oxygen in one liter of water at 1 atm is about 10.9 mg at 10° C., and about 4.9 mg at 100° C. Assume now that 10 mg of oxygen per liter is dissolved in the water-based coolant when the temperature at a time of introducing the water-based coolant in the circulation path in the manufacturing process is 10° C. In this case, as the temperature at the time of use rises, the dissolved oxygen will become gas in the coolant. If the temperature of the water-based coolant reaches 100° C., about 5 mg of oxygen per liter is produced. If the total amount of water-based coolant used in the X-ray apparatus is 10 liters, about 50 mg of oxygen gas is produced. In the case of the coolant mainly consisting of water, the upper limit of the temperature is about 100° C. It is thus desirable that the amount of dissolved oxygen be less than the saturation amount (4.9 mg/liter) of dissolved oxygen at 100° C.

In particular, although the amount of dissolved oxygen should be considered in order to prevent corrosion of metallic parts, the amount of dissolved air in the water-based coolant should be considered in order to prevent occurrence of bubbles due to the rise in temperature of the coolant. Specifically, it is preferable that the amount of dissolved air in the water-based coolant at normal temperature (25° C.) be less than a saturation amount at normal temperature/normal pressure, and it is more preferable that the amount of dissolved air be a saturation amount (about 14.4 mg/liter) or less of dissolved air at 100° C.

The above-described amount of dissolved oxygen can be measured by a fluorescent oxygen meter FOR-21 (manufactured by ORGANO Corporation). The principle of measurement is as follows. If near-ultraviolet is radiated on a special organic substance, fluorescence is emitted. If the special organic substance is immersed in a solution to be measured (e.g. a water-based coolant of a 50% mixture of propylene glycol and pure water), oxygen contained in the solution diffuses and permeates into the organic substance. As a result, the intensity of fluorescence decreases. This physical phenomenon is utilized. This measurement device differs from an ordinary galvano-type or polarography-type one that uses electrochemical principles, and is characterized by less variation in sensitivity and less variation with time.

(Third Reaction Suppressing Method for Electrochemical Corrosion)

The radiator and recoil electron trap are formed of copper or a copper alloy, or the like. The housing is formed of cast aluminum, or the like. The metallic parts of the vacuum envelope and the stationary member are formed of a nickel-plated iron alloy or non-nickel-plated iron alloy, or the like. The ratio of the surface area of the metallic parts, which are in contact with the water-based coolant, to the total area of contact with the water-based coolant is large, and it is thus important to prevent corrosion of these metallic parts.

Preferably, the water-based coolant should contain, as an inhibitor for preventing corrosion of the metallic parts, benzotriazole (BTA), or its derivative, Tolyl triazole (TTA) or BTA carboxylate. For example, these inhibitors may be added to an electrolyte, a hydraulic/oil-hydraulic fluid, circulating water in a solar power system, or cooling water for boilers. In these examples, however, the amount of addition is large, normally 0.2 wt % to 3 wt %. If the inhibitor is added to pure water, it is expected that the electrical conductivity exceeds 50 mS/m. It is unclear whether the medium with this conductivity is applicable to the water-based coolant of the X-ray apparatus.

The inventors conducted experiments, using a 50% mixture of propylene glycol and pure water. As a result, it was confirmed that the minimum amount of addition of the inhibitor, which is necessary to obtain the anti-corrosion effect on the above-mentioned non-ferrous metal, is 0.0005 wt %, and the maximum amount of addition of the inhibitor, which can lower the electrical conductivity at 5 mS/m or less, is 0.02 wt %.

It was thus understood that a significant anti-corrosion effect is obtainable by choosing the optimal amount of addition of the inhibitor, taking into account the required use of electrical conductivity of individual products, the surface area of metal that is to be prevented from corrosion, and the total capacity of water-based coolant. It is also effective to use an additional inhibitor (e.g. molybdate) within such a range as to limit the electrical conductivity of water-based coolant to 5 mS/m or less.

(First Impurity Removing Method)

Figure 7:
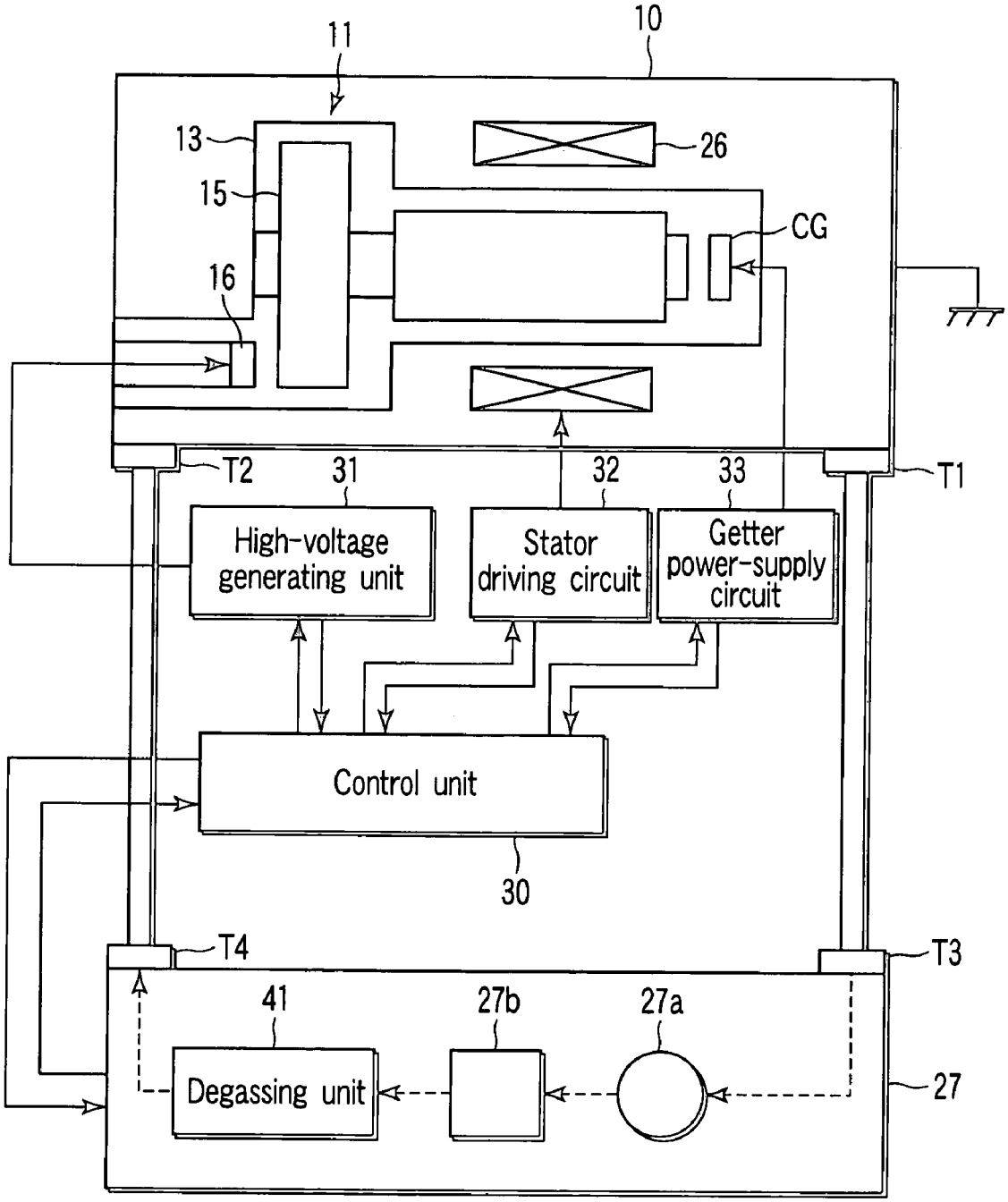
FIG. 7 schematically shows the structure of an X-ray apparatus, which is applicable to the X-ray apparatuses according to the first to sixth embodiments and includes a degassing unit as an impurity removing mechanism that removes impurities in a water-based coolant.

FIG. 7 shows an example of the structure which includes an impurity removing mechanism for removing impurities in a water-based coolant that is used to cool an X-ray apparatus. A description is mainly given of a control system. The structural parts, which have already been described in connection with the first to sixth embodiments, are denoted by like reference numerals, and a detailed description is omitted.

The X-ray apparatus shown in FIG. 7 includes a control unit 30 for controlling the entirety of the apparatus. The control unit 30 controls operations of a cooling unit 27, a high-voltage generating unit 31, a stator driving circuit 32, and a getter power supply circuit 33. Under the control of the control unit 30, the high-voltage generating unit 31 generates a high voltage that is applied to the cathode 16. Under the control of the control unit 30, the stator driving circuit 32 supplies a current to the coil of the stator 26. Under the control of the control unit 30, the getter power supply circuit 33 supplies power to a turn-on getter CG that is disposed within the vacuum envelope 13 of the X-ray tube 11.

In the X-ray apparatus having the above structure, an impurity removing mechanism for removing impurities in the water-based coolant is provided at a position along the circulation path for circulating the water-based coolant. In the example shown in FIG. 7, a degassing unit 41 is provided as the impurity removing mechanism at a position along the circulation path within the cooling unit 27. The position of the degassing unit 41 is not limited to the inside of the cooling unit 27, and may be any position along the circulation path. The degassing unit 41 may be provided within the housing 10 or at a position along the pipes. In the manufacturing process of the X-ray apparatus, a degassing process may be performed through the degassing unit during, or immediately before, a step of introducing the water-based coolant into the circulation path.

Also in order to degas hydrogen gas which occurs with the progress of corrosion of metallic parts due to the water-based coolant during the use of the X-ray apparatus, it is preferable to dispose the degassing unit at a position along the circulation path, thus always removing oxygen gas or hydrogen gas as impurities in the water-based coolant.

Some examples of methods applicable to the degassing unit 41 will be described. First, a vacuum degassing method is applicable. In the vacuum degassing method, a vacuum degassing chamber is provided at a part of the circulation path. A space above a liquid level within the vacuum degassing chamber is evacuated by a vacuum pump. In order to suppress evaporation of water, the degree of vacuum is adjusted at, e.g. 30 kPa. The temperature is also adjusted at, e.g. 40° C. since degassing is facilitated if the temperature is not raised up to such a high level as to cause a problem of evaporation. The degassing process is performed by continuing circulation for a predetermined time period.

Second, it is possible to adopt a method in which degassing is performed with use of a gas permeation membrane. According to this method, a partition wall part, which is formed of a gas permeation membrane that diffuses and passes only gas, is provided at a part of the circulation path. A liquid, a gas or a vacuum, in which the concentration of oxygen is low, is positioned on a side opposite to the circulation path, with the partition wall part being interposed. The degassing process is performed by continuing circulation for a predetermined time period.

As the degassing unit 41 shown in FIG. 7, a hollow fiber membrane degassing module SEPAREL (trademark) (manufactured by DAINIPPON. INK AND CHEMICALS, INC.) is usable. The inventors conducted experiments, using a 50% mixture of propylene glycol and pure water. It was confirmed that sufficient effects can be obtained.

(Second Impurity Removing Method)

Figure 8:
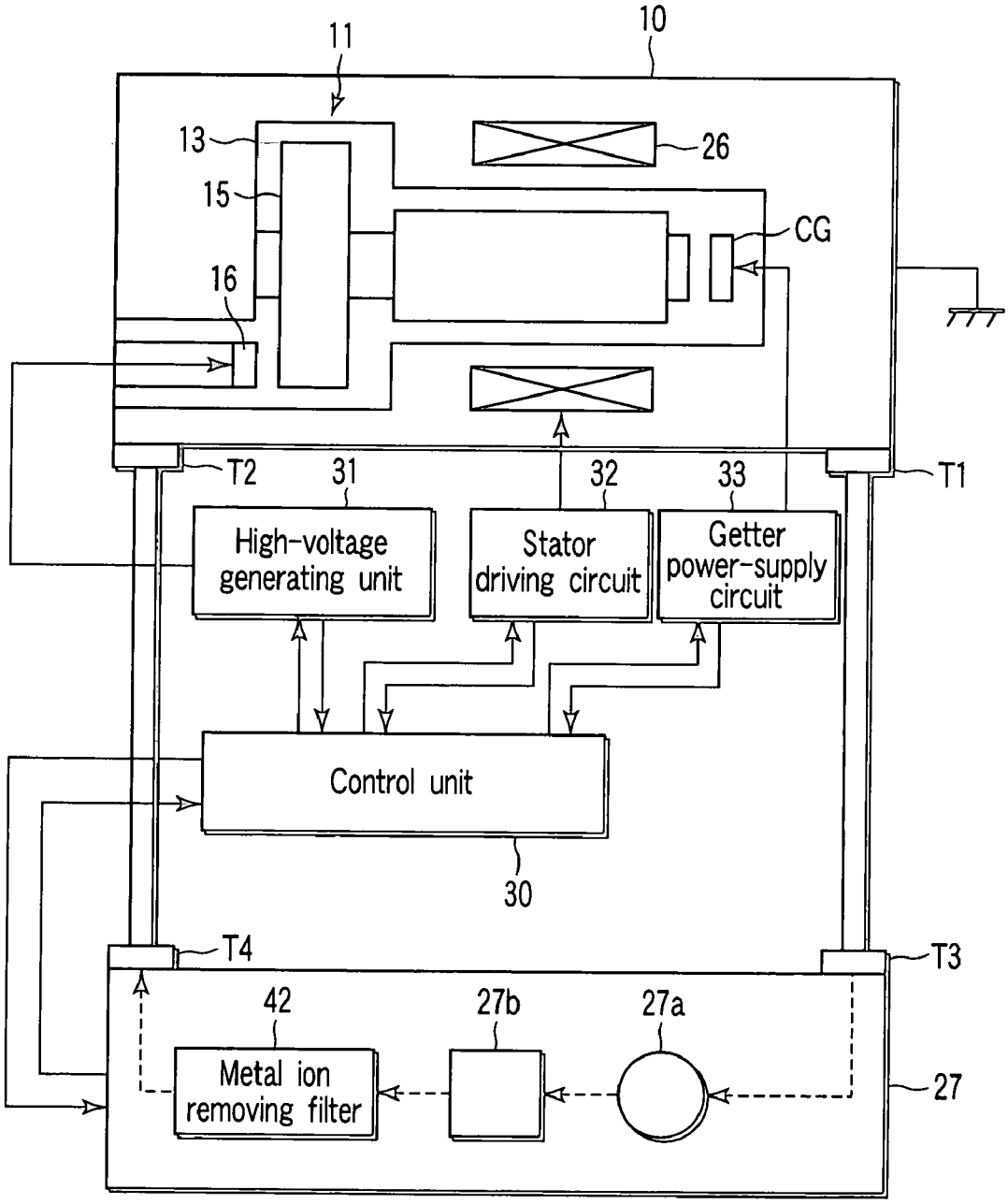
FIG. 8 schematically shows the structure of an X-ray apparatus, which is applicable to the X-ray apparatuses according to the first to sixth embodiments and includes a metal ion filter as an impurity removing mechanism that removes impurities in a water-based coolant.

FIG. 8 shows an example of the structure which includes an impurity removing mechanism for removing impurities in a water-based coolant that is used to cool an X-ray apparatus.

In the X-ray apparatus having the structure shown in FIG. 8, an impurity removing mechanism for removing impurities in the water-based coolant is provided at a position along the circulation path for circulating the water-based coolant. In the example shown in FIG. 8, a metal ion removing filter 42 is provided as the impurity removing mechanism at a position along the circulation path within the cooling unit 27. The position of the metal ion removing filter 42 is not limited to the inside of the cooling unit 27, and may be any position along the circulation path. Preferably, the metal ion removing filter 42 should be provided on the pipe. In the manufacturing process of the X-ray apparatus, a process of removing metal ions in the water-based coolant may be performed through the metal ion removing filter during, or immediately before, a step of introducing the water-based coolant into the circulation path.

Also in order to remove metal ions which occur with the progress of corrosion of metallic parts due to the water-based coolant during the use of the X-ray apparatus, it is preferable to dispose the metal ion removing filter at a position along the circulation path, thus always adsorbing and removing metal ions as impurities in the water-based coolant, which may lead to an increase in electrical conductivity.

The metal ion removing filter 42 includes a metal ion exchange membrane having a cation exchange group for adsorbing and removing metal ions, the metal ion exchange membrane being provided on the surface of a porous membrane that functions as a filter base. As the metal ion removing filter 42, for example, "Protego CF Cartridge Filter" or "Protego CFX Cartridge Filter" (manufactured by Mykrolis Corporation) is usable. The inventors conducted experiments, using a 50% mixture liquid of propylene glycol and pure water. It was confirmed that sufficient effects can be obtained.

A reverse osmosis method using a semi-permeable membrane is usable as another method of removing impurities in the water-based coolant, which may lead to an increase in electrical conductivity. This method is suitable for a pre-process of the water-based coolant. This method can be applied prior to introducing the water-based coolant into the circulation path of the X-ray apparatus.

By adopting the above-described impurity removing methods, the chemical reactions, as expressed by reaction formulae (1) and (2), can be suppressed. In addition, by disposing the impurity removing unit at a position along the circulation path of the water-based coolant in the X-ray apparatus, hydrogen gas, which may occur with the progress of corrosion, can be removed by the degassing unit. Failure due to the occurrence of hydrogen gas can be prevented. Similarly, even if corrosion progresses and metal ions occur in the water-based coolant, the metal ions can be removed by the metal ion removing filter, and failure due to the occurrence of ions can be prevented. The two impurity removing methods are illustrated in FIG. 7 and FIG. 8, respectively. Needless to say, the two methods may be combined, and the effect of the combination can be obtained.

(Electrical Conductivity Measuring Method)

Figure 9:
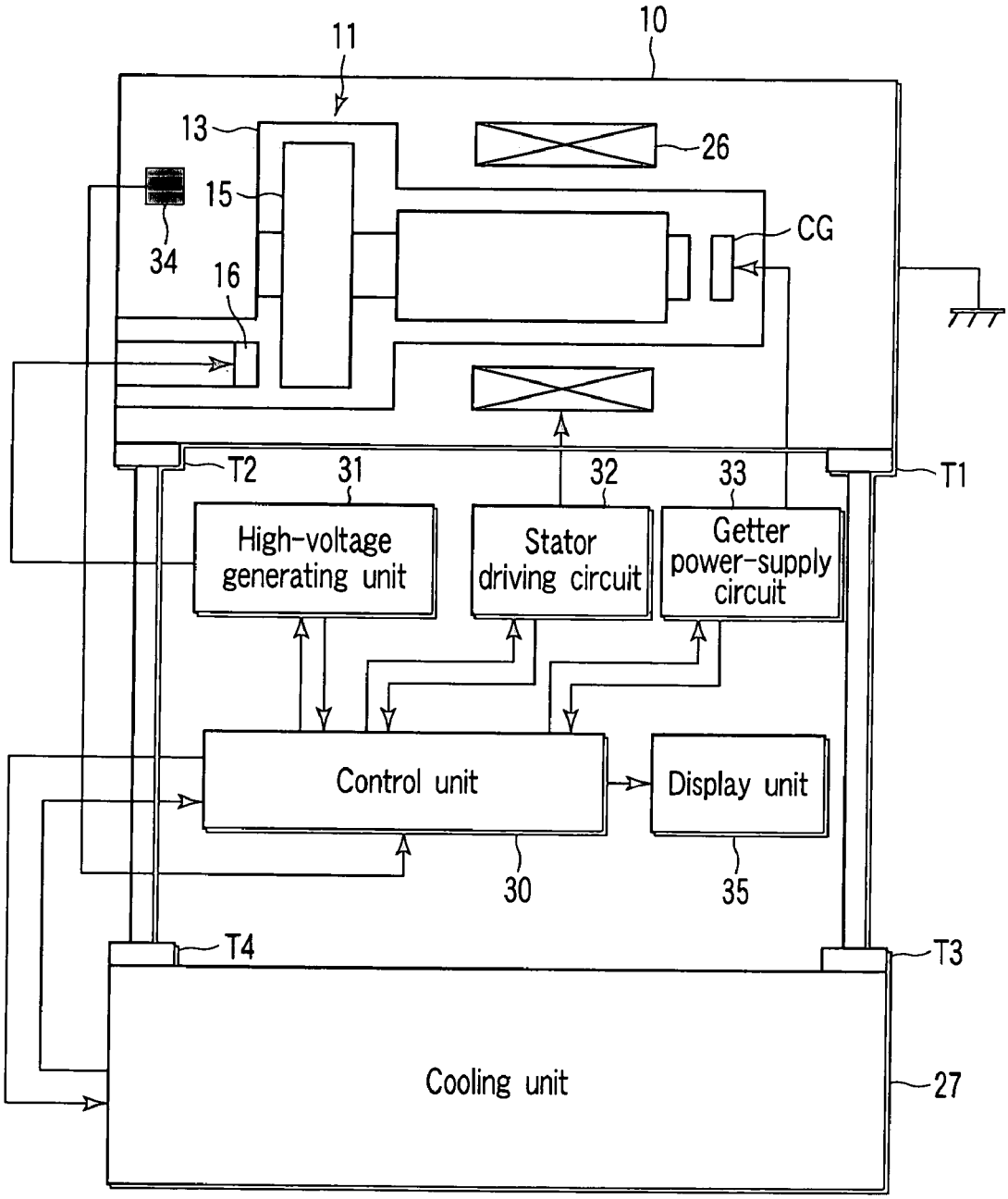
FIG. 9 schematically shows the structure of an X-ray apparatus, which is applicable to the X-ray apparatuses according to the first to sixth embodiments and includes, within a housing, an electrical conductivity monitor that detects an electrical conductivity of a water-based coolant.
Figure 10:
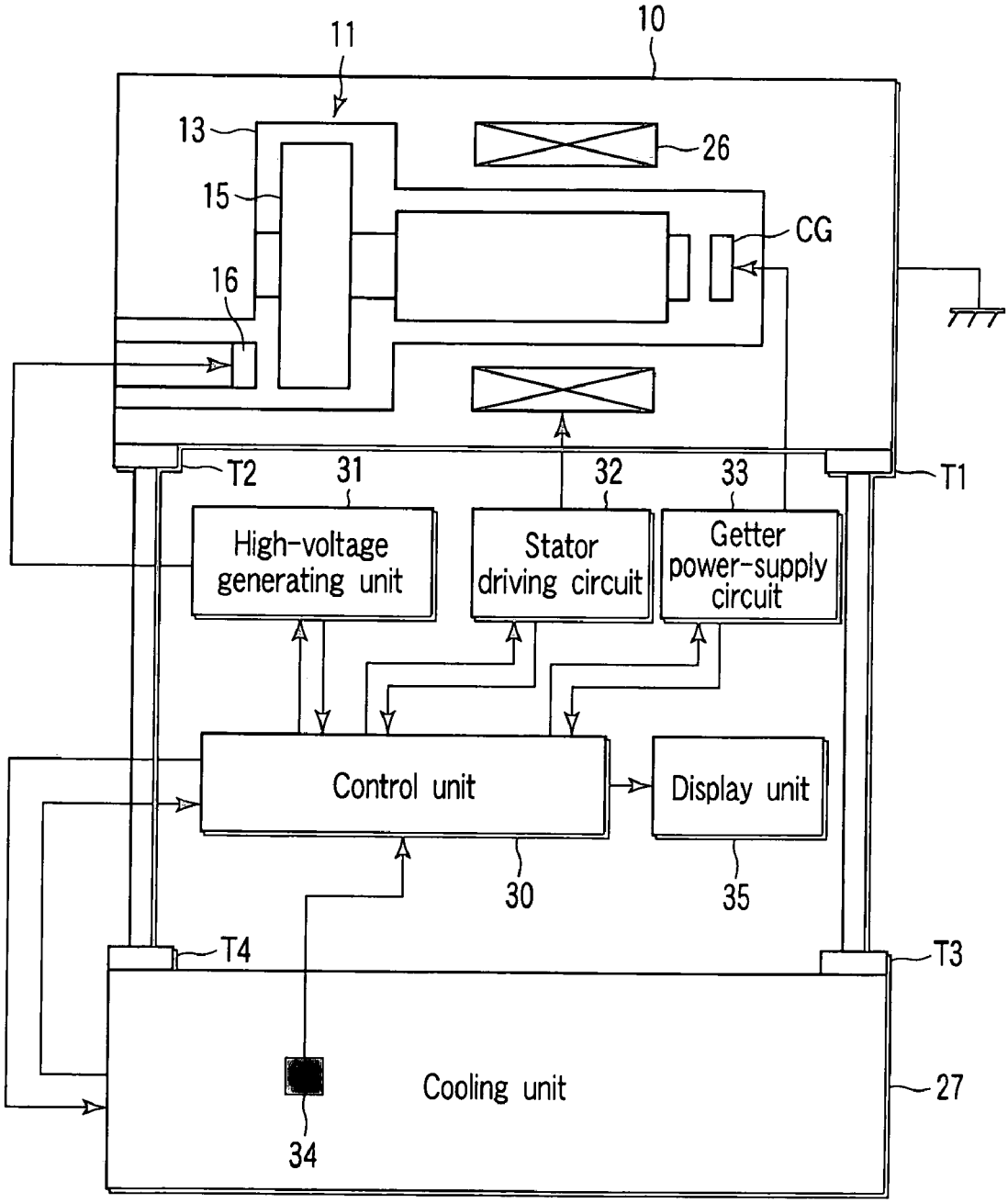
FIG. 10 schematically shows the structure of an X-ray apparatus, which is applicable to the X-ray apparatuses according to the first to sixth embodiments and includes, within a cooling unit, an electrical conductivity monitor that detects an electrical conductivity of a water-based coolant.

FIG. 9 and FIG. 10 show examples of the structure of an X-ray apparatus which includes detection means for detecting the electrical conductivity of a water-based coolant for use in cooling, or a physical amount that varies depending on the electrical conductivity. A description is mainly given of a control system. The structural parts, which have already been described in connection with the first to sixth embodiments, are denoted by like reference numerals, and a detailed description is omitted.

The X-ray apparatus shown in FIG. 9 and FIG. 10 includes a control unit 30 that functions as control means for controlling the entirety of the apparatus. The control unit 30 controls operations of the cooling unit 27, a high-voltage generating unit 31, a stator driving circuit 32, a getter power supply circuit 33, an electrical conductivity monitor 34 functioning as detection means, and a display unit 35 functioning as indication means. The high-voltage generating unit 31, stator driving circuit 32 and getter power supply circuit 33 have already been described with reference to FIG. 7, so a detailed description is omitted.

The electrical conductivity monitor 34 detects the electrical conductivity of the water-based coolant or a physical amount that varies depending on the electrical conductivity, and generates a corresponding detection signal. In the X-ray apparatus, the electrical conductivity monitor 34 is provided at a position along the circulation path for circulating the water-based coolant. In the example shown in FIG. 9, the electrical conductivity monitor 34 is provided at a position along the circulation path within the housing 10. In the example shown in FIG. 10, the electrical conductivity monitor 34 is provided at a position along the circulation path within the cooling unit 27. The position of the electrical conductivity monitor 34 may be any position along the circulation path, and may be a position on the pipe.

Applicable examples of the electrical conductivity monitor 34 are described. In a usable method of measuring the electrical conductivity of the water-based coolant, for example, a pair of opposed metal electrodes are inserted in the water-based coolant. The resistivity or conductivity (inverse number of resistivity) of an alternating current or direct current, which flows between the metal electrodes, is measured. The metal electrode may have a plane-parallel plate shape, a parallel rod shape or a coaxial shape.

In the X-ray apparatus having the above structure, the control unit 30 determines abnormality in electrical conductivity of the water-based coolant circulating in the circulation path, on the basis of the detection signal output from the electrical conductivity monitor 34. Specifically, the control unit 30 has a preset threshold value of electrical conductivity. The threshold value is set as such an electrical conductivity as not to cause dielectric breakdown via the water-based coolant within the X-ray apparatus. It is possible to preset a plurality of threshold values, such as an upper limit value at which the electrical conductivity of the water-based coolant can be determined to be normal, an upper limit value at which the electrical conductivity is determined to require caution, and an upper limit value at which the electrical conductivity is determined to be abnormal.

Based on the detection signal from the electrical conductivity monitor 34, the control unit 30 executes a control to prohibit or permit an X-ray output operation by the rotation-anode type X-ray tube 11. Specifically, the control unit 30 compares the detection signal from the electrical conductivity monitor 34 and the threshold value. If the control unit 30 detects abnormality in electrical conductivity, it controls the high-voltage generating unit 31, prohibits voltage supply to the cathode 16, and stops the X-ray output operation by the rotation-anode type X-ray tube 11. Thereby, failure due to an increase in electrical conductivity can be prevented.

The control unit 30 controls the display unit 35 on the basis of the detection signal from the electrical conductivity monitor 34, and causes the display unit 35 to display a determination result based on the detection signal from the electrical conductivity monitor 34. For example, the display unit 35 displays the state of degradation of the water-based coolant by classifying the state of degradation into categories such as "normal", "caution" and "abnormal".

Thereby, the degradation in performance of the water-based coolant is always checked by self-diagnosis. Before failure occurs, the user or serviceman can exactly be informed of the need for maintenance, such as a replacement work of the water-based coolant, a replacement work of the cooling unit or a replacement work of the anode-rotation type X-ray tube. Therefore, it is possible to prevent problems relating to the safety in use of the X-ray apparatus, the economical efficiency and the reliability.

(Leak Current Measuring Method)

Figure 11:
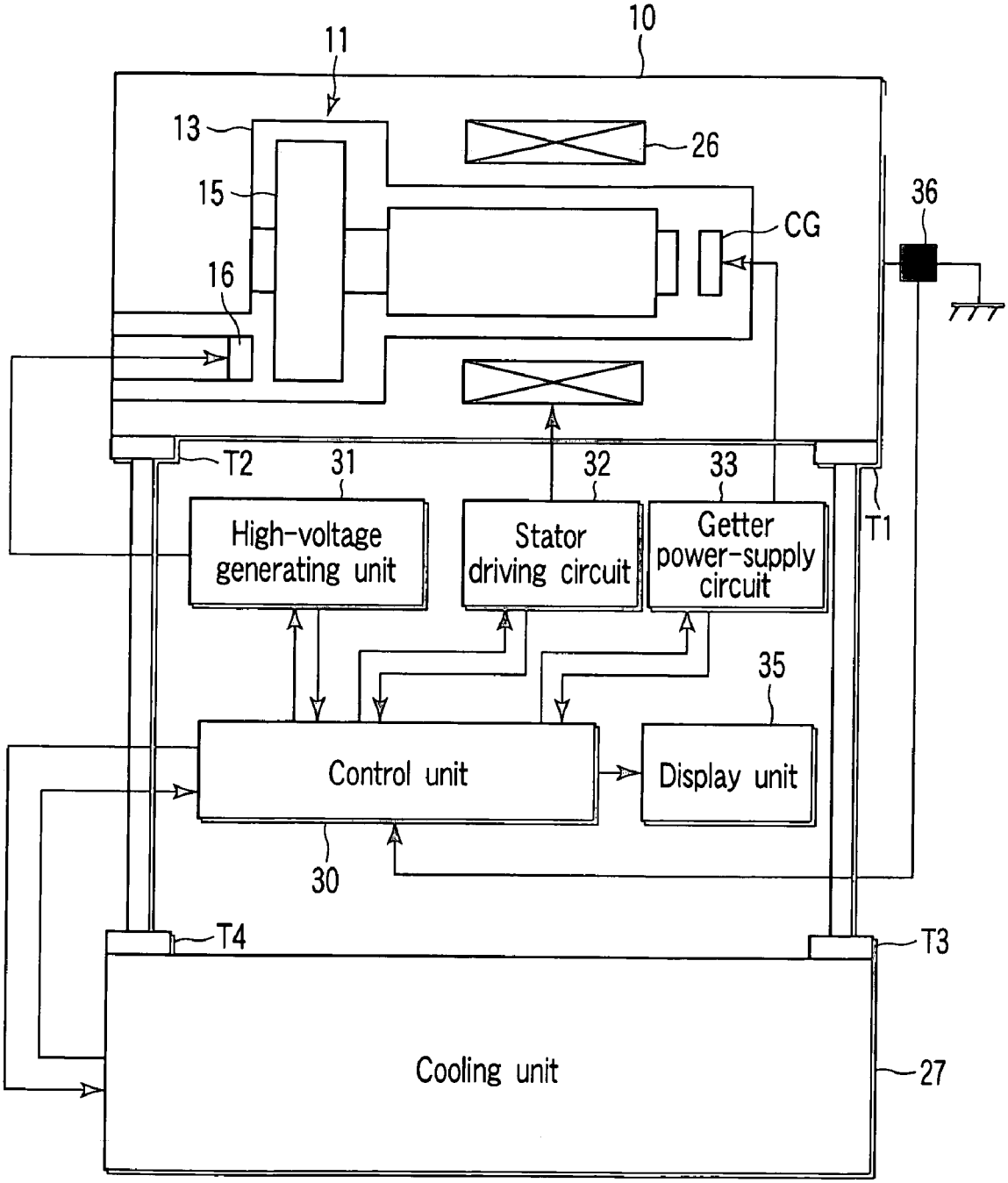
FIG. 11 schematically shows the structure of an X-ray apparatus, which is applicable to the X-ray apparatuses according to the first to sixth embodiments and includes a leak current monitor that detects a leak current.

FIG. 11 shows an example of the structure of an X-ray apparatus which includes detection means for detecting a leak current of the X-ray apparatus or a physical amount that varies depending on the leak current. A description is mainly given of a control system. The structural parts, which have already been described in connection with the first to sixth embodiments, are denoted by like reference numerals, and a detailed description is omitted.

The X-ray apparatus shown in FIG. 11 includes a control unit 30 that functions as control means for controlling the entirety of the apparatus. The control unit 30 controls operations of the cooling unit 27, a high-voltage generating unit 31, a stator driving circuit 32, a getter power supply circuit 33, a leak current monitor 36 functioning as detection means, and a display unit 35 functioning as indication means. The leak current monitor 36 includes a circuit for detecting a leak current, which flows through a ground line connected to the housing 10, or a physical amount that varies depending on the leak current, and generating a corresponding detection signal.

In the X-ray apparatus having the above structure, the control unit 30 determines abnormality in leak current on the basis of the detection signal output from the leak current monitor 36. Specifically, the control unit 30 has a preset threshold value of leak current. The threshold value is set as such a leak current value as not to cause abnormality in the X-ray apparatus. It is possible to preset a plurality of threshold values, such as an upper limit value at which leak current can be determined to be normal, an upper limit value at which leak current is determined to require caution, and an upper limit value at which leak current is determined to be abnormal.

Based on the detection signal from the leak current monitor 36, the control unit 30 executes a control to prohibit or permit an X-ray output operation by the rotation-anode type X-ray tube 11. Specifically, the control unit 30 compares the detection signal from the leak current monitor 36 and the threshold value. If the control unit 30 detects abnormality in leak current, it controls the high-voltage generating unit 31, prohibits voltage supply to the cathode 16, and stops the X-ray output operation by the rotation-anode type X-ray tube 11. Thereby, failure due to a leak current that reaches a preset value can be prevented.

The control unit 30 controls the display unit 35 on the basis of the detection signal from the leak current monitor 36, and causes the display unit 35 to display a determination result based on the detection signal from the leak current monitor 36. For example, the display unit 35 displays the state of detected leak current by classifying the state into categories such as "normal", "caution" and "abnormal".

Thereby, the degradation in performance of the water-based coolant is always checked by self-diagnosis. Before failure occurs, the user or serviceman can exactly be informed of the need for maintenance, such as a replacement work of the water-based coolant, a replacement work of the cooling unit or a replacement work of the anode-rotation type X-ray tube. Therefore, it is possible to prevent problems relating to the safety in use of the X-ray apparatus, the economical efficiency and the reliability.

The methods of measuring the electrical conductivity and leak current have been described with reference to different drawing figures. Needless to say, synergistic effects can be obtained by combining the methods.

The present invention is not limited to the above-described embodiments. At the stage of practicing the invention, various embodiments may be made by modifying the structural elements without departing from the spirit of the invention. Structural elements disclosed in the embodiments may properly be combined, and various inventions may be made. For example, some structural elements may be omitted from the embodiments. Moreover, structural elements in different embodiments may properly be combined.

For example, in the first and second embodiments, the insulating oil is used as the first coolant that fills the inside of the housing, and the antifreeze liquid, which has a higher heat transfer efficiency than the first coolant, is used as the second coolant that fills the circulation path. However, the combination of the first coolant and second coolant is not limited to the combination of the insulating oil and antifreeze liquid, and other combinations of coolants can be used.

Similarly, in the third to sixth embodiments, the antifreeze liquid, which has a higher heat transfer efficiency than the insulating oil, is used as the coolant that fills the housing and circulation path. However, the coolant, which is applicable to these embodiments, is not limited to the antifreeze liquid, and other coolants are usable.

In the first to sixth embodiments, the dynamic-pressure slide bearing is used in the rotational support mechanism that rotatably supports the anode target. However, in this invention, an antifriction bearing using a ball bearing, or a magnetic bearing can be used. Even in cases where these bearings are used, if coupling between the stator coil and the rotary driving unit of the rotary member is not deficient or high-speed rotation is performed, the temperature of the coil may rise. In these cases, the same advantageous effects as in the above embodiments can be obtained by adopting the structures of these embodiments.

Figure 12:
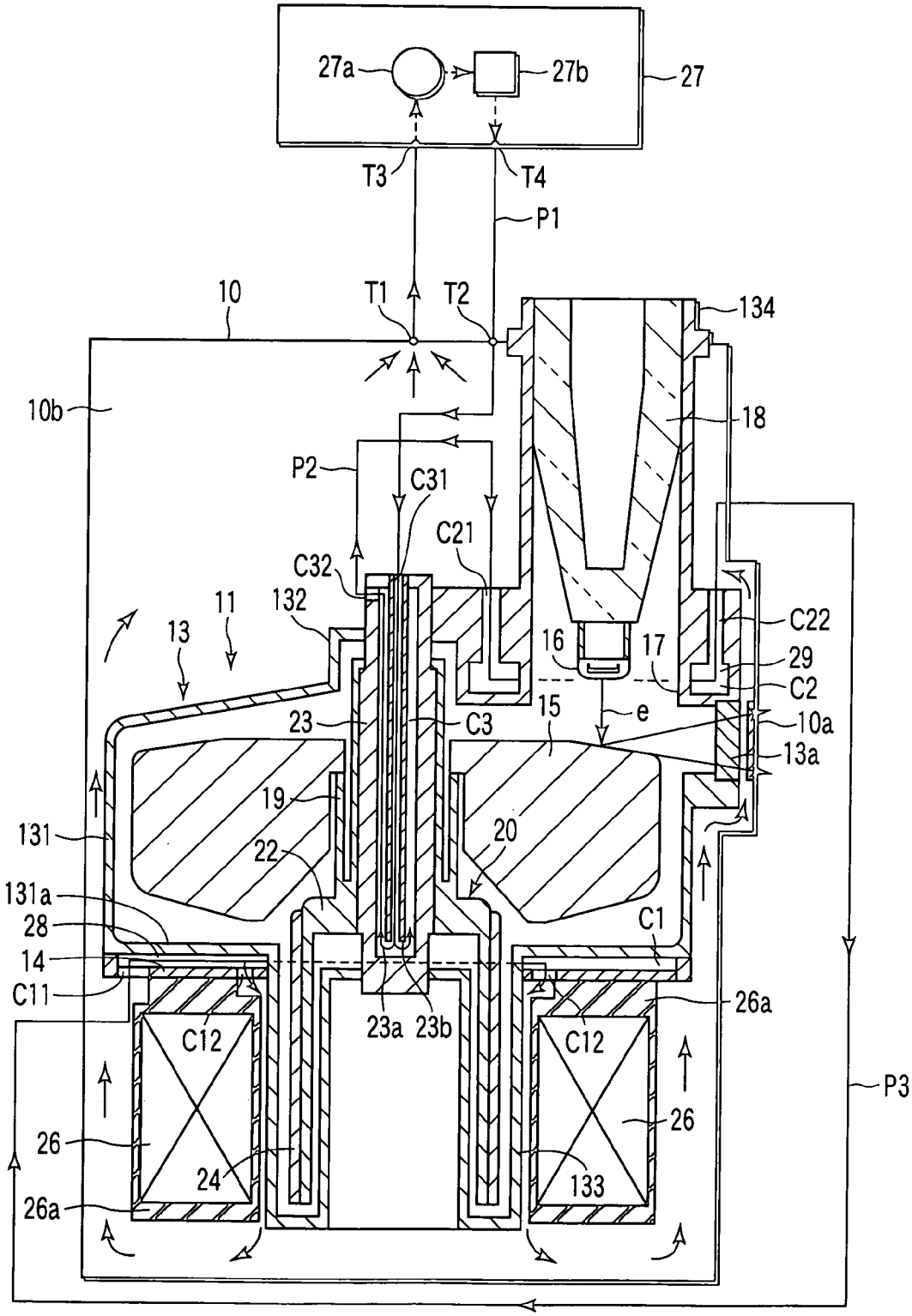
FIG. 12 schematically shows the structure of an X-ray apparatus according to a modification.

It is desirable that the water-based coolant, which is fed from the cooling unit, be introduced into the part that is to be preferentially cooled, such as a part with low durability to heat or a part with high heat production. For example, as in a modification of the third embodiment, as shown in FIG. 12, pipes P1, P2 and P3 may connect, respectively, the cooling unit 27 and inlet C31, the outlet C32 and inlet C21, and the outlet C22 and inlet C11.

The outlet C12 drains the antifreeze liquid, which is introduced into the first cooling path C1, into the inner space 10*b* of the housing 10. The connection part T1 between the hose and the housing 10 functions as an outlet for outputting the antifreeze liquid from the inner space 10*b* of the housing 10 to the cooling unit 27 via the hose. In short, a return path of the antifreeze liquid is formed between the inner space 10*b* of the housing 10 and the cooling unit 27 (i.e. between the connection parts T1 and T3). Thus, the inner space 10*b*, which accommodates the rotation-anode type X-ray tube 11, is filled with the antifreeze liquid that is the water-based coolant. In this way, a circulation path of the antifreeze liquid is so formed as to include the pipes P1, P2 and P3, the first cooling path C1, second cooling path C2, third cooling path C3, and the return path.

In this case, the antifreeze liquid, which is fed out of the heat exchanger 27*b* of the cooling unit 27, is introduced into the inlet C31 via the pipe P1 and cools the stationary member 23 while passing through the cavity 23*a* (third cooling path C3) that is so formed as to permit reciprocal flow of the antifreeze liquid within the stationary member 23. The antifreeze liquid coming out of the outlet C32 is introduced into the inlet C21 via the pipe P2 and cools the recoil electron trap 17 while passing through the annular space 29 (second cooling path C2). The antifreeze liquid coming out of the outlet C22 is introduced into the inlet C11 via the pipe P3 and cools the large-diameter portion 131 of the vacuum envelope 13 while passing through the discoidal space 28 (first cooling path C1). The antifreeze liquid, which is drained from the outlet C12, is returned to the cooling unit 27 via the pipe P4.

According to this structure, it is possible to provide an X-ray apparatus wherein the part that is to be preferentially cooled is efficiently cooled, and high reliability is secured for a long time. Although the modification of the first embodiment alone is described, similar structures can be applied to the other embodiments.

As has been described above, the present invention can provide an X-ray apparatus which can improve heat radiation characteristics and can have high reliability for a long time.

What is claimed is:

1. An X-ray apparatus comprising:

a rotation-anode type X-ray tube which is configured such that a rotatable anode target and a cathode that is disposed to be opposed to the anode target are accommodated within a vacuum envelope;

a stator which generates an induction electromagnetic field for rotating the anode target;

a housing which accommodates and holds at least the rotation-anode type X-ray tube;

a circulation path which is provided near at least a part of the rotation-anode type X-ray tube, and through which a water-based coolant is circulated, the water-based coolant having an amount of dissolved oxygen comprising 5 mg/liter or less at 25° C.; and a cooling unit including a circulation pump and said water-based coolant, which is provided at a position along the circulation path and forcibly feeds the water-based coolant, and a radiator which radiates heat of the water-based coolant.

2. An X-ray apparatus comprising:

a rotation-anode type X-ray tube which is configured such that a rotatable anode target and a cathode that is disposed to be opposed to the anode target are accommodated within a vacuum envelope;

a stator which generates an induction electromagnetic field for rotating the anode target;

a housing which accommodates and holds at least the rotation-anode type X-ray tube;

a circulation path which is provided near at least a part of the rotation-anode type X-ray tube, and through which a water-based coolant is circulated, the water-based coolant having electrical conductivity comprising 5 mS/m or less at 25° C.; and a cooling unit including a circulation pump and said water-based coolant, which is provided at a position along the circulation path and forcibly feeds the water-based coolant, and a radiator which radiates heat of the water-based coolant.

3. An X-ray apparatus comprising:

a rotation-anode type X-ray tube which is configured such that a rotatable anode target and a cathode that is disposed to be opposed to the anode target are accommodated within a vacuum envelope;

a stator which generates an induction electromagnetic field for rotating the anode target;

a housing which accommodates and holds at least the rotation-anode type X-ray tube;

a circulation path which is provided near at least a part of the rotation-anode type X-ray tube, and through which a water-based coolant is circulated, the water-based coolant including an inhibitor, benzotriazole or a derivative thereof; and a cooling unit including a circulation pump and said water-based coolant, which is provided at a position along the circulation path and forcibly feeds the water-based coolant, and a radiator which radiates heat of the water-based coolant.

4. An X-ray apparatus comprising:

a rotation-anode type X-ray tube which is configured such that a rotatable anode target and a cathode that is disposed to be opposed to the anode target are accommodated within a vacuum envelope;

a stator which generates an induction electromagnetic field for rotating the anode target;

a housing which accommodates and holds at least the rotation-anode type X-ray tube;

a circulation path which is provided near at least a part of the rotation-anode type X-ray tube, and through which a water-based coolant is circulated;

a cooling unit including a circulation pump and said water-based coolant, which is provided at a position along the circulation path and forcibly feeds the water-based coolant, and a radiator which radiates heat of the water-based coolant; and an impurity removing mechanism comprising a degassing unit that includes a gas permeation membrane to remove impurities and gas in the water-based coolant.

5. An X-ray apparatus comprising:

a rotation-anode type X-ray tube which is configured such that a rotatable anode target and a cathode that is disposed to be opposed to the anode target are accommodated within a vacuum envelope;

a stator which generates an induction electromagnetic field for rotating the anode target;

a housing which accommodates and holds at least the rotation-anode type X-ray tube;

a circulation path which is provided near at least a part of the rotation-anode type X-ray tube, and through which a water-based coolant is circulated;

a cooling unit including a circulation pump, which is provided at a position along the circulation path and forcibly feeds the water-based coolant, and a radiator which radiates heat of the water-based coolant; and an impurity removing mechanism comprising a metal ion removing filter having an ion exchange membrane which includes at least a cation exchange group for adsorbing and removing metal ions in the water-based coolant.

6. The X-ray apparatus according to claim 5, wherein the ion exchange membrane is provided on a surface of a porous member.

7. An X-ray apparatus comprising:

a rotation-anode type X-ray tube which is configured such that a rotatable anode target and a cathode that is disposed to be opposed to the anode target are accommodated within a vacuum envelope;

a stator which generates an induction electromagnetic field for rotating the anode target;

a housing which accommodates and holds at least the rotation-anode type X-ray tube;

a circulation path which is provided near at least a part of the rotation-anode type X-ray tube, and through which a water-based coolant is circulated; and a cooling unit including a circulation pump, which is provided at a position along the circulation path and forcibly feeds the water-based coolant, and a radiator which radiates heat of the water-based coolant, wherein the X-ray apparatus further comprises:

detection means for detecting an electrical conductivity of the water-based coolant or a physical amount that varies depending on the electrical conductivity, or a leak current of the X-ray apparatus or a physical amount that varies depending on the leak current, and generating a detection signal; and control means for executing, based on the detection signal of the detection means, a control to prohibit or permit an X-ray output operation by the rotation-anode type X-ray tube.

8. The X-ray apparatus according to claim 7, wherein the detection means is provided within the housing.

9. The X-ray apparatus according to claim 7, wherein the detection means is provided within the cooling unit.

10. The X-ray apparatus according to claim 7, further comprising indication means for indicating a determination result by the control means.

* * * * *